US006795666B2

(12) United States Patent
Miyabe et al.

(10) Patent No.: US 6,795,666 B2
(45) Date of Patent: Sep. 21, 2004

(54) REMANUFACTURING METHOD FOR PROCESS CARTRIDGE

(75) Inventors: Shigeo Miyabe, Numazu (JP); Hiroomi Matsuzaki, Mishima (JP); Akira Suzuki, Odawara (JP); Kazuo Chadani, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 10/128,337

(22) Filed: Apr. 24, 2002

(65) Prior Publication Data

US 2002/0159788 A1 Oct. 31, 2002

(30) Foreign Application Priority Data

Apr. 27, 2001 (JP) ..... 2001-132649

(51) Int. Cl.[7] ..... G03G 15/00
(52) U.S. Cl. ..... 399/109
(58) Field of Search ..... 399/109, 111, 399/113, 114; 264/36.12, 36.1

(56) References Cited

U.S. PATENT DOCUMENTS

| | | | | |
|---|---|---|---|---|
| 5,331,373 A | | 7/1994 | Nomura et al. | 355/200 |
| 5,452,056 A | | 9/1995 | Nomura et al. | |
| 5,463,446 A | | 10/1995 | Watanabe et al. | |
| 5,585,889 A | | 12/1996 | Shishido et al. | |
| 5,640,650 A | | 6/1997 | Watanabe et al. | 399/117 |
| 5,839,028 A | | 11/1998 | Nomura et al. | 399/109 |
| 5,873,012 A | | 2/1999 | Miyabe et al. | 399/90 |
| 5,878,309 A | | 3/1999 | Nomura et al. | 399/111 |
| 5,878,310 A | | 3/1999 | Noda et al. | 399/117 |
| 5,926,666 A | | 7/1999 | Miura et al. | 399/25 |
| 5,943,529 A | | 8/1999 | Miyabe et al. | 399/111 |
| 5,946,531 A | | 8/1999 | Miura et al. | 399/111 |
| 5,950,047 A | | 9/1999 | Miyabe et al. | 399/111 |
| 5,966,566 A | * | 10/1999 | Odagawa et al. | 399/109 |
| 5,966,567 A | | 10/1999 | Matsuzaki et al. | 399/111 |
| 6,011,941 A | | 1/2000 | Takashima et al. | 399/111 |
| 6,029,031 A | * | 2/2000 | Yokomori et al. | 399/109 |
| 6,072,968 A | | 6/2000 | Nomura et al. | 399/113 |
| 6,097,906 A | | 8/2000 | Matsuzaki et al. | 399/90 |
| 6,128,452 A | | 10/2000 | Miyabe et al. | 399/90 |
| 6,144,815 A | | 11/2000 | Chadani et al. | 399/27 |
| 6,154,623 A | | 11/2000 | Suzuki et al. | 399/111 |
| 6,167,219 A | | 12/2000 | Miyamoto et al. | 399/90 |
| 6,173,140 B1 | | 1/2001 | Suzuki et al. | 399/113 |
| 6,173,145 B1 | | 1/2001 | Chadani et al. | 399/265 |
| 6,178,302 B1 | | 1/2001 | Nagashima et al. | 399/106 |
| 6,205,305 B1 | | 3/2001 | Suzuki et al. | 399/106 |

(List continued on next page.)

FOREIGN PATENT DOCUMENTS

| | | |
|---|---|---|
| JP | 8-305258 | 11/1996 |
| JP | 9-62167 | 3/1997 |
| JP | 2001-34143 | 2/2001 |

*Primary Examiner*—Robert Beatty
(74) *Attorney, Agent, or Firm*—Fitzpatrick, Cella, Harper & Scinto

(57) ABSTRACT

A remanufacturing method for a process cartridge detachably mountable to a main assembly of an electrophotographic image forming apparatus, includes an end cover removing step of cutting a fixing portion between a first end cover and a drum holding frame and cutting a fixing portion between the first end cover and a developer accommodating frame, and removing the first end cover at a longitudinal end of the drum holding frame, a developing means frame and the developer accommodating frame; and an end cover removing step of cutting a fixing portion between a second end cover and the drum holding frame and cutting a fixing portion between the second end cover and the developer accommodating frame, and removing the second end cover at a longitudinal end of the drum holding frame, the developing means frame and the developer accommodating frame.

27 Claims, 33 Drawing Sheets

U.S. PATENT DOCUMENTS

| | | | | |
|---|---|---|---|---|
| 6,215,969 | B1 | | 4/2001 | Nomura et al. ..... 399/111 |
| 6,219,504 | B1 | | 4/2001 | Matsuzaki et al. ..... 399/92 |
| 6,223,010 | B1 | * | 4/2001 | Araki ..... 399/109 |
| 6,246,853 | B1 | | 6/2001 | Suzuki et al. ..... 399/262 |
| 6,282,389 | B1 | | 8/2001 | Matsuzaki et al. ..... 399/111 |
| 6,282,390 | B1 | | 8/2001 | Miyabe et al. ..... 399/111 |
| 6,301,457 | B1 | | 10/2001 | Chadani et al. ..... 391/167 |
| 6,317,572 | B1 | | 11/2001 | Miyabe et al. ..... 399/111 |
| 6,336,017 | B1 | | 1/2002 | Miyamoto et al. ..... 399/116 |
| 6,351,620 | B1 | | 2/2002 | Miyabe et al. ..... 399/111 |
| 6,397,025 | B1 | * | 5/2002 | Higeta et al. ..... 399/109 |
| 6,542,706 | B2 | * | 4/2003 | Toba et al. ..... 399/111 |
| 6,577,829 | B2 | * | 6/2003 | Higeta et al. ..... 399/109 |
| 6,615,008 | B2 | * | 9/2003 | Higeta et al. ..... 399/109 |

* cited by examiner

REMANUFACTURING METHOD FOR PROCESS CARTRIDGE

FIELD OF THE INVENTION AND RELATED ART

The present invention relates to a process cartridge remanufacturing method. Here, a process cartridge means such a cartridge that integrally comprises at minimum a developing means and an electrophotographic photoconductive member, and that is removably mountable in the main assembly of an electrophotographic image forming apparatus.

An electrophotographic image forming apparatus includes an electrophotographic copying machine, an electrophotographic printer (for example, LED printer, laser beam printer, and the like), an electrophotographic facsimile, an electrophotographic word processor, and the like.

In an electrophotographic image forming apparatus, a process cartridge system has long been employed. According to this system, an electrophotographic photoconductive member, and a single or plurality of processing means, which act on the electrophotographic photoconductive member, are integrated into a form of a cartridge removably mountable in the main assembly of the image forming apparatus. This system enables a user him/her self to maintain the apparatus without relying on a service person, immensely improving the operability of the apparatus. Thus, the process cartridge system has been widely used in the field of an image forming apparatus.

A process cartridge such as the one described above forms an image on recording medium with the use of developer (toner) contained therein. Therefore, the amount of the developer therein gradually reduces with image formation, eventually to a level below which it fails to form an image satisfactory in quality to the user who purchased the process cartridge. At this point, the process cartridge loses its commercial value.

Thus, it has long been desired to realize a simple method for remanufacturing a process cartridge so that a process cartridge which has lost its commercial value due to the depletion of the developer therein can be marketed again.

SUMMARY OF THE INVENTION

The primary object of the present invention is to provide a simple method for remanufacturing a process cartridge.

Another object of the present invention is to provide a method for remanufacturing a process cartridge, the commercial value of which has been lost due to the consumption of the developer therein to a level below which the process cartridge fails to forms an image satisfactory in quality to a user who has purchased the process cartridge.

According to an aspect of the present invention, there is provided a remanufacturing method for a process cartridge detachably mountable to a main assembly of an electrophotographic image forming apparatus, wherein said process cartridge including a drum frame supporting an electrophotographic photosensitive drum and having at one end a driving force receiving portion for receiving a driving force for rotating said electrophotographic photosensitive drum from the main assembly of the electrophotographic image forming apparatus when said process cartridge is mounted to the main assembly of the electrophotographic image forming apparatus; a developing frame supporting a developing roller for developing an electrostatic latent image formed on said electrophotographic photosensitive drum, a developer frame having a developer accommodating portion for accommodating a developer to be used to develop the electrostatic latent image by said developing roller; a first end cover fixed to one longitudinal ends of said drum frame, said developing frame and said developer frame and fixed to said one ends of said drum frame and said developer frame; and a second end cover fixed to the other longitudinal ends of said drum frame, said developing frame and said developer frame and fixed to the other ends of said drum frame and said developer frame, said second end cover including a grip for facilitating mounting and demounting of process cartridge relative to the main assembly of electrophotographic image forming apparatus, said method comprising:

(a) an end cover removing step of cutting a fixing portion between said first end cover and said drum frame and cutting a fixing portion between said first end cover and said developer frame, and removing said first end cover at said other longitudinal ends of said drum frame, said developing frame and said developer frame;

(b) an end cover removing step of cutting a fixing portion between said second end cover and said drum frame and cutting a fixing portion between said second end cover and said developer frame, and removing said second end cover at said other longitudinal ends of said drum frame, said developing frame and said developer frame;

(c) a drum frame separating step of pulling, after said developer frame is removed, a pin provided in said one longitudinal end of said drum frame out of said drum frame, and removing a spring mounted between one longitudinal end of said drum frame and one longitudinal end of said developing frame, and then separating said drum frame and said developing frame;

(d) a drum bearing removing step of removing, at said other ends, a drum bearing supporting said electrophotographic photosensitive drum at said one ends;

(e) a drum shaft removing step of removing, at said other ends, a drum shaft supporting said electrophotographic photosensitive drum at said other ends;

(f) a drum removing step of removing said one end of said electrophotographic photosensitive drum from said drum frame, thus removing said photosensitive drum from said drum frame;

(g) a drum mounting step of inserting one end of a new electrophotographic photosensitive drum having at one end a driving force receiving portion for receiving a driving force for rotating said electrophotographic photosensitive drum from the main assembly of the electrophotographic image forming apparatus when process cartridge is mounted to the main assembly of the electrophotographic image forming apparatus, such that driving force receiving portion is exposed outside said drum frame, and inserting the drum shaft at the other end from outside of said drum frame, thus mounting a new drum electrophotographic photosensitive drum to said drum frame;

(h) a developing frame coupling step of inserting, after said electrophotographic photosensitive drum is mounted to said drum frame, the pin through or into said one longitudinal end of drum frame and said one longitudinal end of said developing frame, and mounting the spring between said one longitudinal end of said drum frame and said one longitudinal end of said developing frame, thus coupling said drum frame and said developing frame;

(i) a developer refilling step of refilling a developer into said developer accommodating portion;

(j) a first end cover mounting step of fixedly mounting a first end cover to said one longitudinal ends of said drum frame, said developing frame and said developer frame; and (k) a second end cover mounting step of fixedly mounting a second end cover to said other longitudinal ends of said drum frame, said developing frame and said developer frame.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described with reference to the appended drawings. In the following descriptions, a term "lengthwise direction" means the direction which is perpendicular to the recording medium conveyance direction, and parallel to the surface of the recording medium being conveyed. When a process cartridge is in the image forming apparatus main assembly, the lengthwise direction of the photoconductive drum coincides with the "lengthwise direction".

(Description of Process Cartridge and Apparatus Main Assembly)

Figure 1:
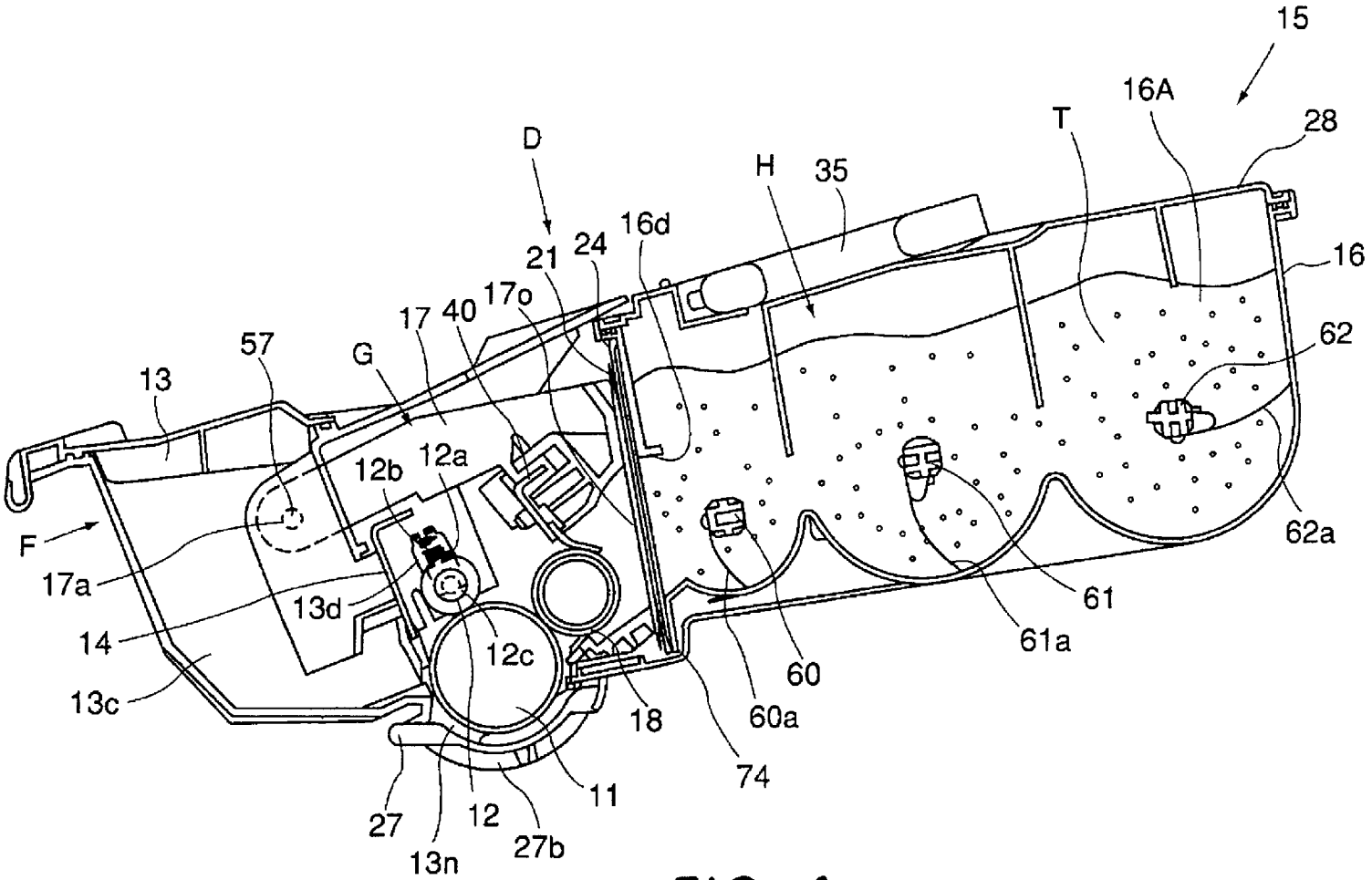
FIG. 1 is a vertical sectional view of a process cartridge at a plane perpendicular to the lengthwise direction of the axial line of the photoconductive drum.
Figure 2:
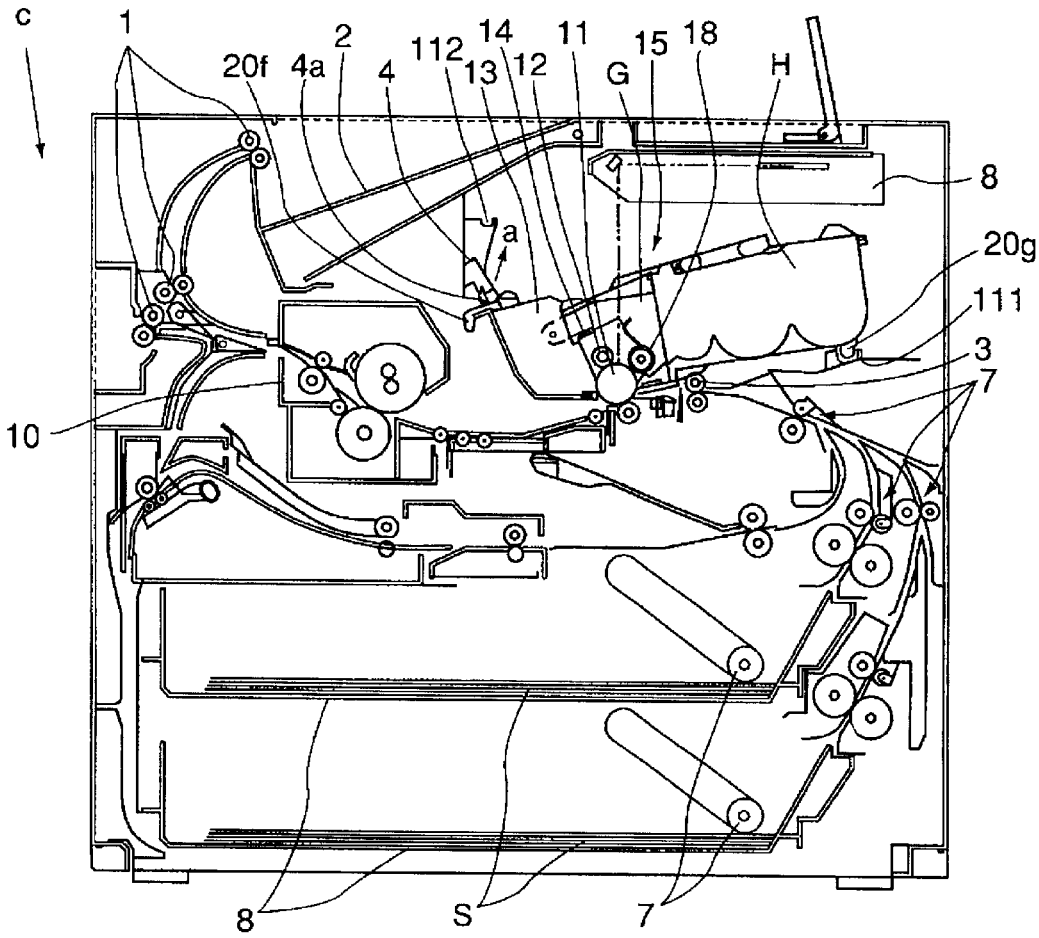
FIG. 2 is a vertical sectional view of an electrophotographic image forming apparatus, at a plane perpendicular to the axial line of the electrophotographic photoconductive drum.

FIG. 1 is a sectional view of a process cartridge, at a plane perpendicular to the lengthwise direction, and FIG. 2 is a sectional view of an electrophotographic image forming apparatus, at a plane perpendicular to the lengthwise direction.

The process cartridge 15 in this embodiment comprises a cleaning unit F and a developing apparatus D, which are joined to each other. As shown in FIG. 1, the unit F comprises: a drum holding frame 13, in which a charge roller 12 as a charging means, and a cleaning blade 14 as a cleaning means, are disposed around an electrophotographic photoconductive drum 11 (which hereinafter will be referred to as photoconductive drum), and which also serves as a cleaning means holding frame; and a drum shutter 27 attached to the drum holding frame 13 to protect the photoconductive drum 11. The developing apparatus D comprises a development unit G, and a toner holding unit H. The development unit G comprises a development roller 18, a development blade 40, and a developing means holding frame 17 in which the development roller 18 and development blade 40 are disposed. The toner holding unit H, which is a unit for holding the toner T as developer, comprises: stirring members 60, 61, and 62 as a rotational member for stirring the toner T; a developer holding frame 16 in which the stirring members 60, 61, and 62 are disposed; and a toner storage lid 28 which is welded to the developer holding frame 16. The process cartridge 15 is structured so that grasping the handle 35 on top of the toner storage lid 28 makes it possible to removably mount or dismount the process cartridge 15, into or from, the image forming apparatus main assembly C, without subjecting the processing means to an undue amount of force.

This cartridge 15 is mounted in an image forming apparatus such as the one shown in FIG. 2, to be used for an image forming operation, which is carried out in the following manner: a sheet S is conveyed by conveying rollers 7, from a sheet cassette 6 mounted in the bottom portion of the image forming main assembly C to the portion of the photoconductive drum 11 within the transfer station in which a transferring operation is carried out. The photoconductive drum 11 is charged by the charge roller 12, and selectively exposed by an exposing apparatus 8, in accordance with the image formation data. As a result, an electrostatic latent image is formed. The exposing operation by the exposing apparatus 8 is carried out in synchronism with the conveyance of the sheet S by a registration roller pair 3.

Meanwhile, the toner T in the toner holding unit H is conveyed to the development unit G so that the toner T is borne in a thin layer on the peripheral surface of the development roller 18 by the development blade 40. Then, development bias is applied to the development roller 18 so that the toner T is supplied to the peripheral surface of the photoconductive drum 11 in a manner to reflect the aforementioned latent image. As a result, a toner image is formed on the peripheral surface of the photoconductive drum 11. This toner image is transferred onto the aforementioned sheet S, which is being conveyed through the transfer station, by the application of bias voltage to the transfer roller 9. Then, the sheet S is conveyed to a fixing apparatus 10, in which the toner image is fixed to the sheet S. Then, the sheet S is discharged into a delivery portion 2 on top of the apparatus main assembly, by sheet discharge rollers 1. Meanwhile, the residual toner, that is, the toner T remaining on the peripheral surface of the photoconductive drum 11, is removed by the cleaning blade 14, and is collected into the residual toner bin 13*c*.

(Structure of Process Cartridge Frame)

Figure 3:
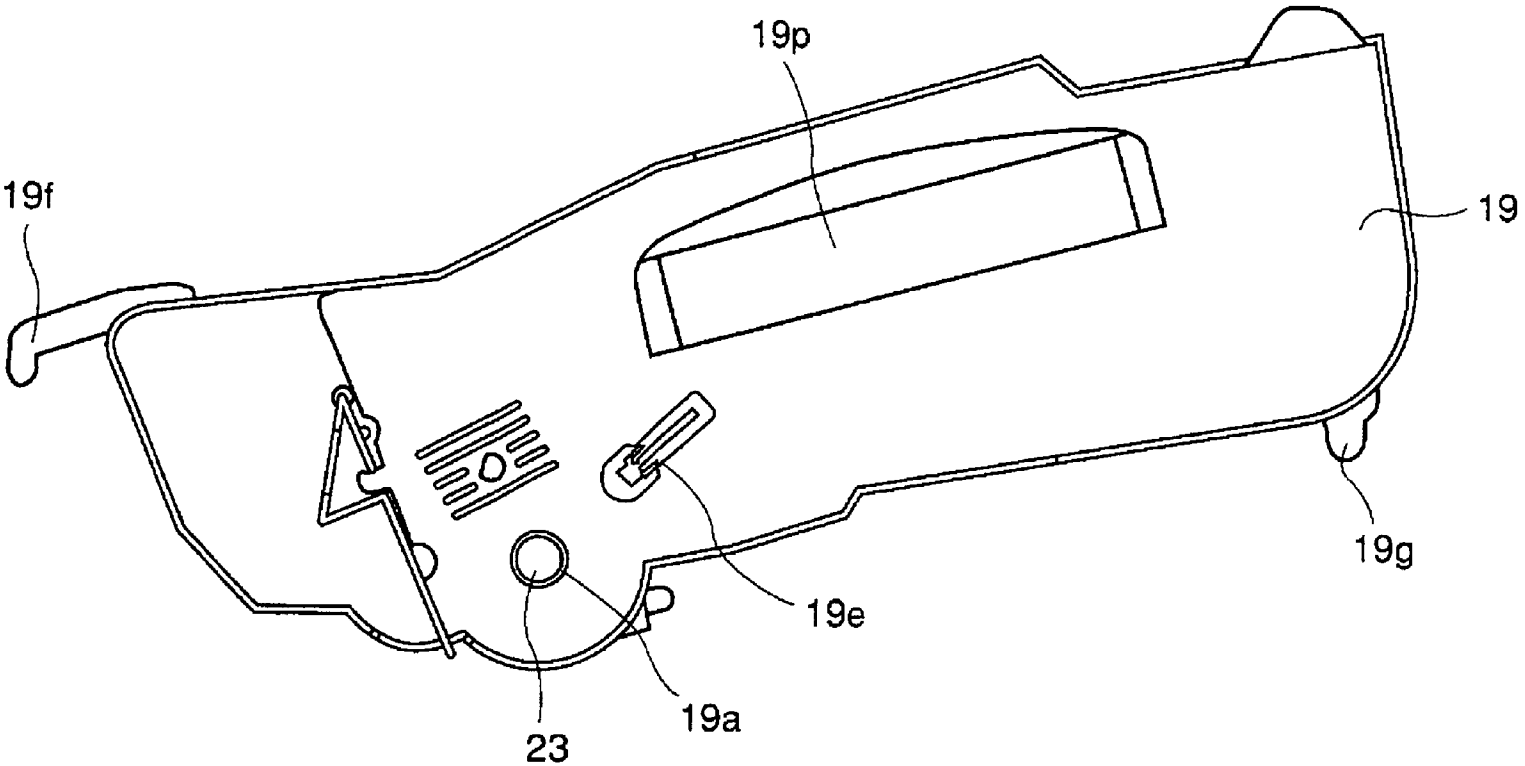
FIG. 3 is an external plan view of one of the lengthwise ends of the process cartridge.
Figure 4:
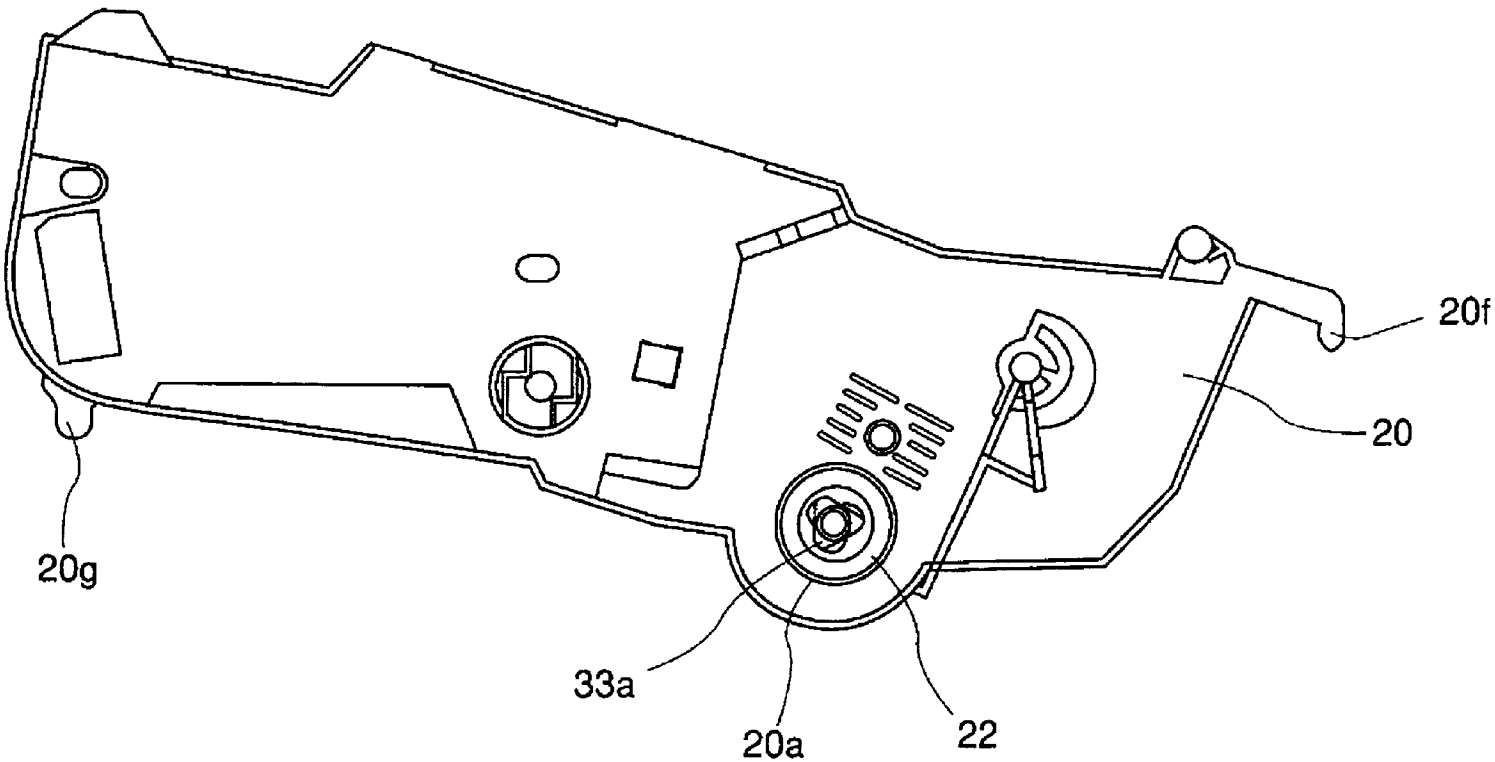
FIG. 4 is an external plan view of the other lengthwise end of the process cartridge.
Figure 5:
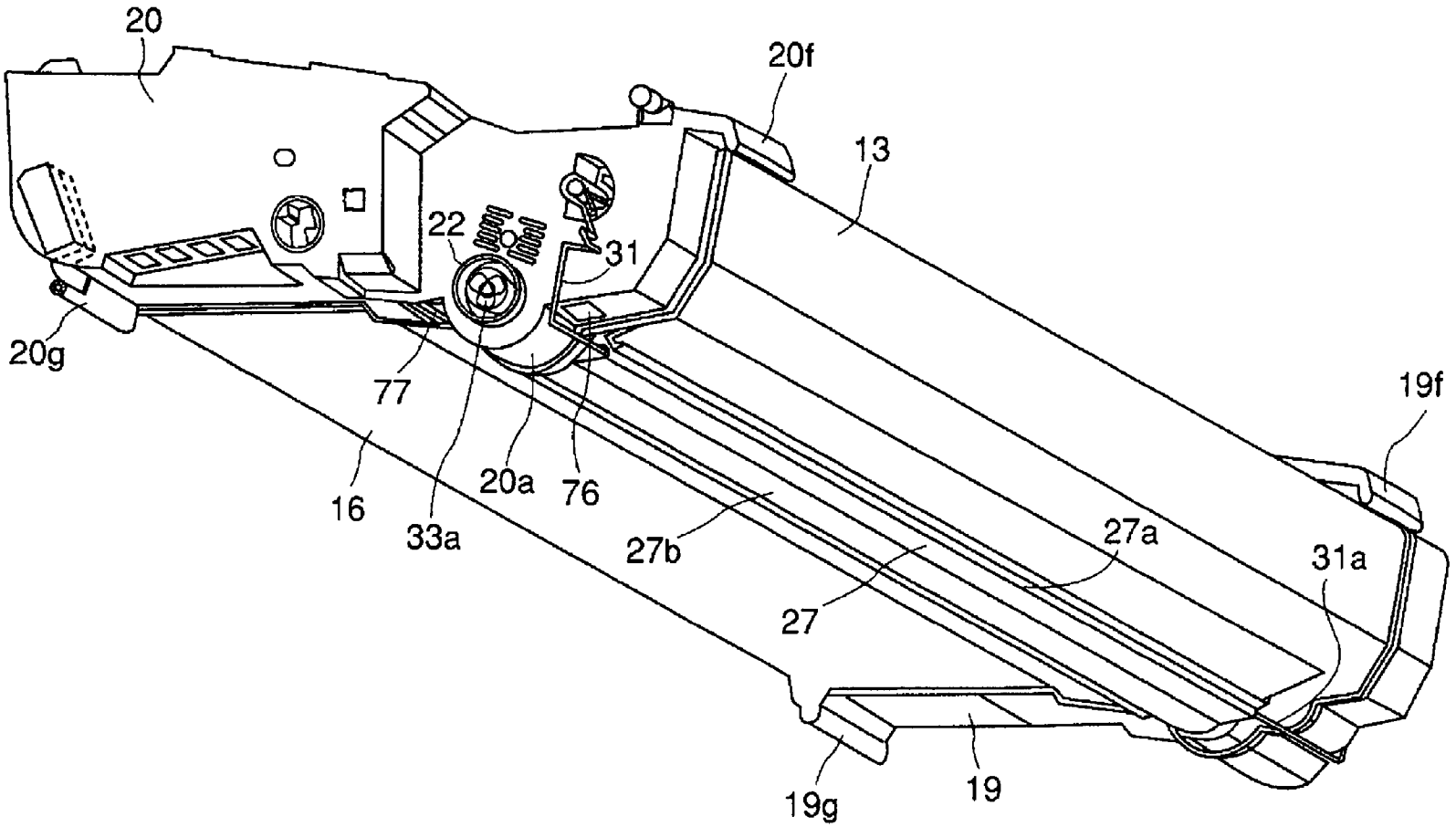
FIG. 5 is a perspective view of the process cartridge as seen from diagonally below.
Figure 6:
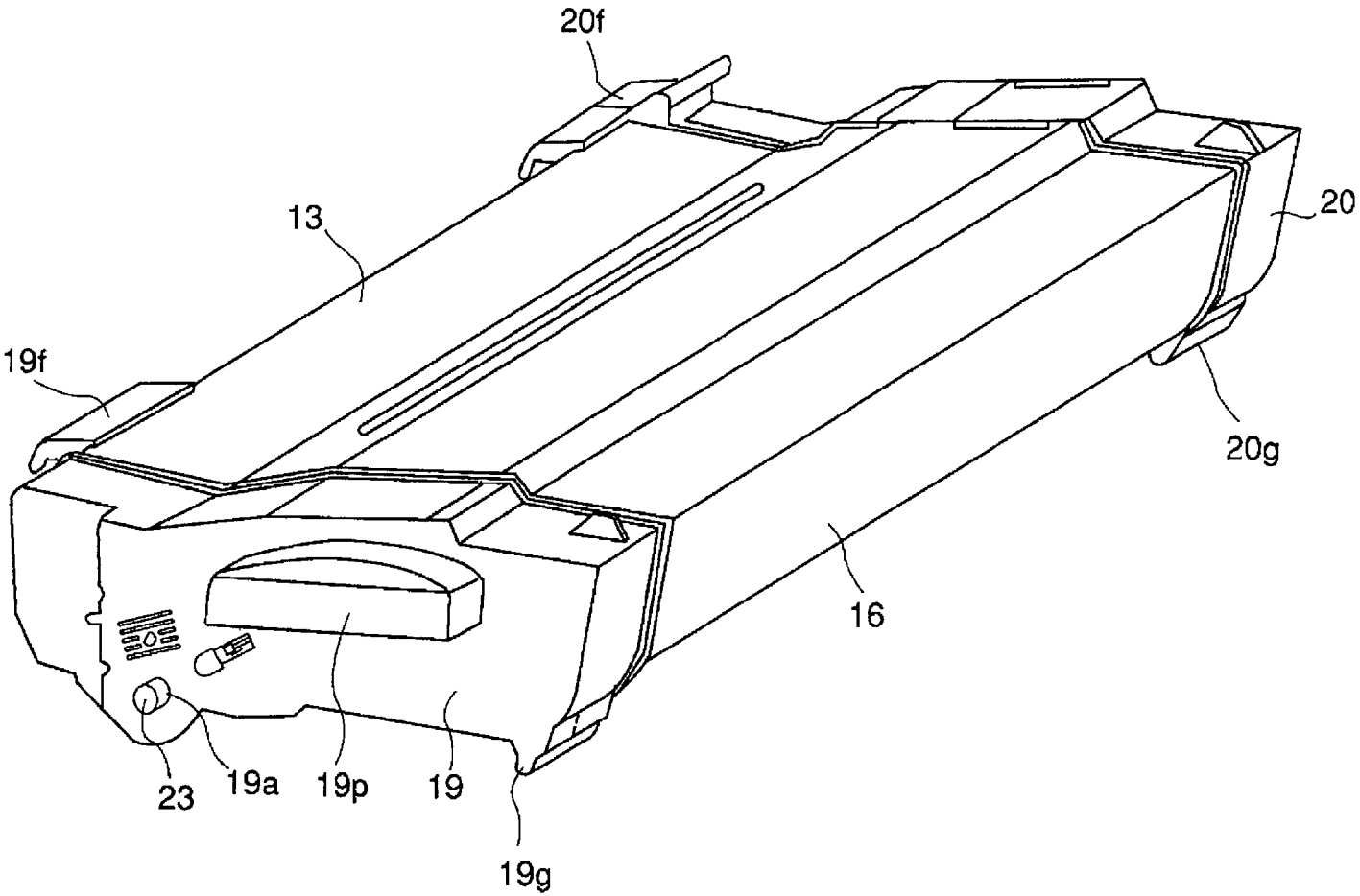
FIG. 6 is a perspective view of the process cartridge as seen from diagonally above.
Figure 7:
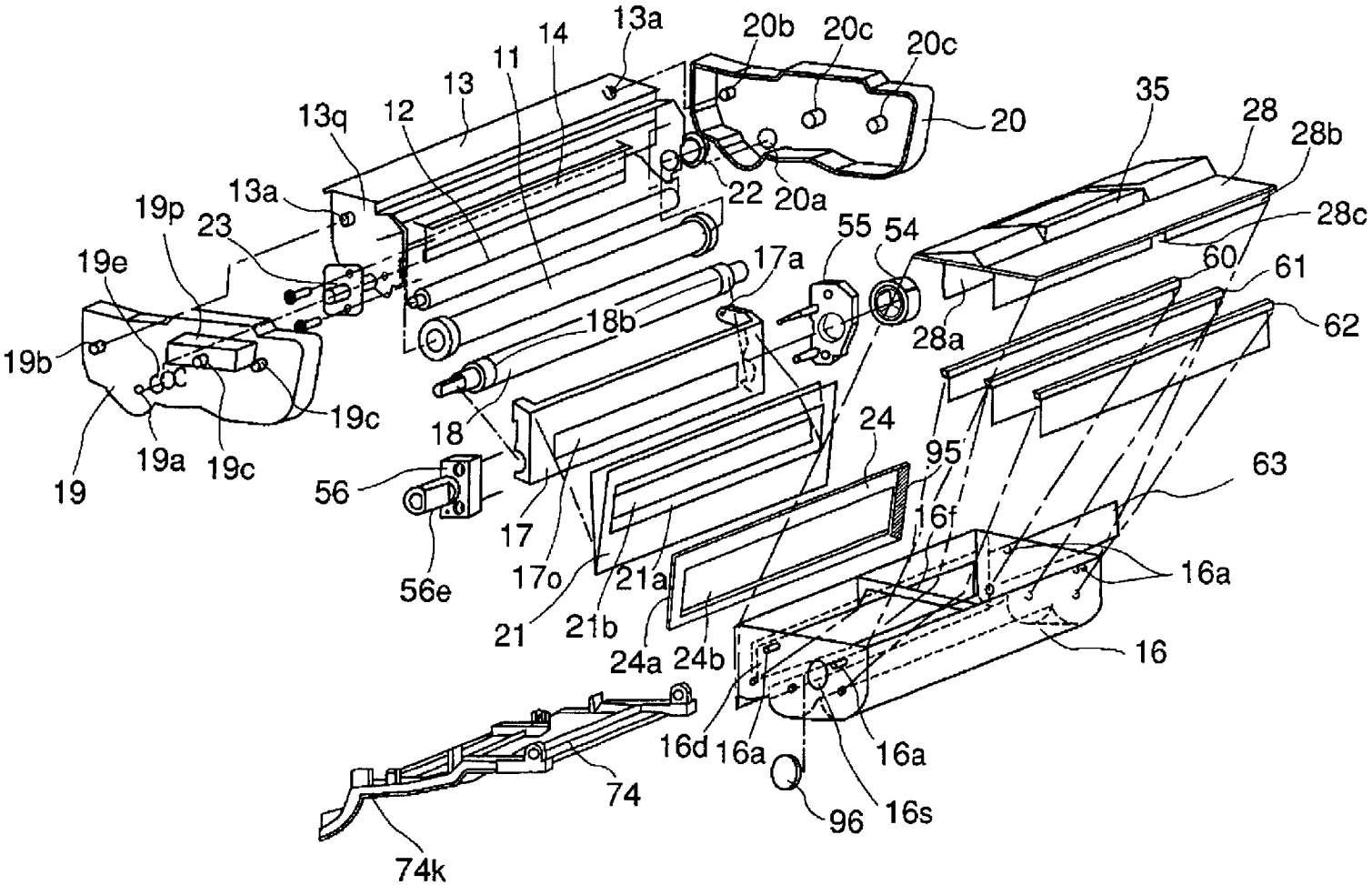
FIG. 7 is an exploded perspective view of the process cartridge, for showing the components and structure of the cartridge.

Next, referring to FIGS. 1, 3, 4, 5, 6, and 7, the structure of the cartridge 15 will be described. FIG. 3 is an external plan view of one of the end walls of the cartridge 15 in terms of the axial direction of the photoconductive drum 11, and FIG. 4 is an external plan view of the other wall of the cartridge 15. FIGS. 5 and 6 are external perspective views of the cartridge 15. FIG. 7 is an exploded perspective view of the cartridge 15, for showing the components and structure of the cartridge 15. Hereafter, the rear of the image forming apparatus main assembly as seen from the viewer side, in terms of the direction perpendicular to the plane of the FIG. 2, or the direction perpendicular to the lengthwise direction of the photoconductive drum 11, will be referred to as rear, whereas the other side, or the side opposite to the rear side, will be referred to as front. Further, the side from which driving force is transmitted is referred to as driven side, and the side opposite to the driven side will be referred to as non-driven side.

Referring to FIGS. 1 and 7, the cartridge 15 comprises three units: cleaning unit F, development unit G, and toner storage unit H. The cleaning unit F comprises a drum bearing 22, a drum shaft 23, the photoconductive drum 11, the charge roller 12, the cleaning blade 14, and the drum holding frame 13, in which the preceding components are held, and which also constitutes the residual toner bin 13*c*; the photoconductive drum 11 is rotationally supported by the drum holding frame 13 with the interposition of a drum shaft 23. The development unit G comprises the development roller 18, a development blade 40 (unshown in FIG. 7), and the developing means holding frame 17 in which the development roller 18 and development blade 40 are integrally supported. The toner storage unit H comprises a developer storage portion 16A including a developer storing frame 16, and the like. Further, the cartridge 15 comprises second and first end covers 19 and 20, which are secured to the front and rear ends of the drum holding frame 13 and developer holding frame 16 in order to integrally support these three units.

Figure 22:
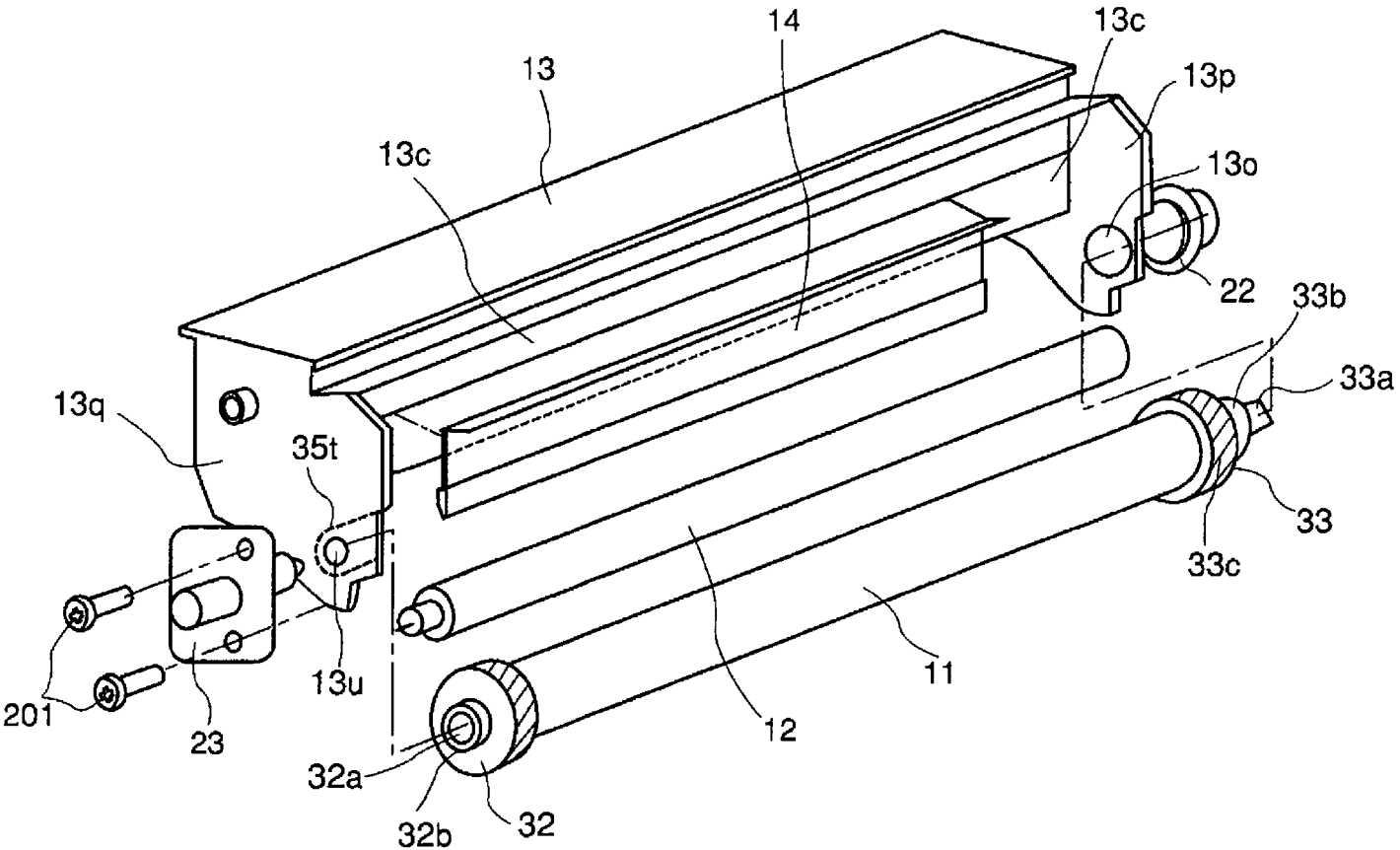
FIG. 22 is an exploded perspective view of the cleaning unit, for showing the method for disassembling the cleaning unit.

Referring to FIG. 22, the photoconductive drum 11 is provided with drum flanges 32 and 33, which are attached to the lengthwise ends of the photoconductive drum 11, one for one. The drum holding frame 13 is provided with end plates 13*q* and 13*p*, which are on the non-driven and driven sides, respectively. To the end plates 13*q*, the drum shaft 23 is solidly attached with the use of small screws 201. The end plate 13*p*, or the end plate on the driven side, is provided with a cylindrical projection (unshown in FIG. 22), which projects outward and has a hole 13*o* in which the drum shaft 22 is fitted. The drum flange 32 of the photoconductive drum 11 on the non-driven side is provided with a center hole 32*a*, in which the drum shaft 23 is fitted, and the journal 33*b* of the drum flange 33 on the driven side is fitted in the drum bearing 22, being rotationally supported. The journal 33*b* is smaller in diameter than the hole 13*o*, and is not supported by the wall of the hole 13*o*.

Referring to FIG. 7, the second end cover 19 (non-driven side) is large enough to cover the entirety of the cross section of the cartridge 15 perpendicular to the lengthwise direction of the cartridge 15. It constitutes one of the lengthwise end portions of the cassette 15, integrally supporting the drum holding frame 13 and developer holding frame 16 in such a positional relationship that the axial line of the hole 19*a* of the second end cover 19 coincides with the axial line of the photoconductive drum 11 supported by the drum holding frame 13. In other words, when the second end cover 19 is attached to the non-driven side of the cartridge 15, the position of the second end cover 19 is accurately fixed by the drum shaft 23; the positional relationship between the drum holding frame 13 and developer holding frame 16 in terms of the pivotal angles relative to each other is determined by the positioning portion 19*b* of the second end cover 19, which is located so that it will be as far away as possible from the photoconductive drum 11 after the attachment of the second end cover 19, and the positioning portion 13*a* of the end plate 13*q*, which is located as far away as possible from the photoconductive drum 11. The developer holding frame 16 is provided with positioning portions 16*a*, which project outward from one of the lengthwise end walls of the developer holding frame 16, and are fitted in the positioning portion 19*c* of the second end cover 19 to accurately position the drum holding frame 13 and developer holding frame 16. The first end cover 20 on the other side accurately positions the drum holding frame 13 and developer holding frame 16 relative to each other, by being attached to the other side of the cartridge 15, in the same manner as the second end cover 19 is attached to the non-driven side of the cartridge 15. Incidentally, the drum shaft 23 also functions to position the cartridge 15 relative to the image forming apparatus main assembly C.

The drum shutter 27 (unshown in FIG. 7) protects the photoconductive drum 11; it prevents the hand of a user coming into contact with the portion of the photoconductive drum 11 exposed through the transfer opening of the cartridge 15, through which the transfer roller 9 opposes the photoconductive drum 11, and/or prevents the ambient light from being projected upon the photoconductive drum 11. The drum shutter 27 is retracted by a drum shutter opening/closing mechanism (unshown), as the cartridge is moved into the predetermined position in the image forming apparatus main assembly C. The shutter 27 is fitted with a shutter link 31, which is attached to the long edge portion 27*a*, or one of the long edges of the shutter 27. The shutter link 31 is bent at each of the lengthwise ends of the long edge portion 27*a*, in a manner to make each bent portion follow the surface of the corresponding end cover 19, or 20. The end portion of each bent portion of the shutter link 31 is bent toward the corresponding end cover 19 or 20, being fitted in the hole of the corresponding end cover 19 or 20. The cover portion 27*b* pivotally connected to the long edge portion 27*a* is large enough to cover the transfer opening 13*n*, through which the photoconductive drum 11 is exposed from the cartridge 15. The transfer opening 13*n* is a narrow rectangular hole between the drum holding frame 13 and developing means holding frame 17, extending in the lengthwise direction of the photoconductive drum 11. The shutter link 31 and cover portion 27*b* are kept pressed by a single or plurality of unshown springs in the direction for the drum shutter 27 to cover the transfer opening 13*n*.

The bottom joint between the developing means holding frame 17 and developer holding frame 16, and its adjacencies, are covered with a cover 74, which prevents the jointing sheet 21, which will be described later, from coming into direct contact with a user. The cover 74 is supported by the developer holding frame 16 and drum holding frame 13, being prevented from contacting the developing means holding frame 17.

Next, referring to FIGS. 1 and 7, the positioning of the developing means holding frame 17 will be described. The developing means holding frame 17 is supported by the drum holding frame 13 in such a manner that the axial lines of the photoconductive drum 11 and development roller 18 pivot in an oscillatory manner about the axial line of the hole 17*a* of the developing means holding frame 17, with the photoconductive drum 11 and development roller 18 remaining in contact with each other. In other words, the developing means holding frame 17 which supports the development roller 18 is supported by the driven side of the drum holding frame 13, so that the developing means holding frame 17 is allowed to pivot in an oscillatory manner about the axial line of the hole 17*a*, whereas the drum holding frame 13 and developer holding frame 16 are secured to each other so that they do not move relative to each other, as described before. Therefore, the developing means holding frame 17 is allowed to move relative to the developer holding frame 16.

Solidly fixed to the end of the developing means holding frame 17 on the non-driven side is a development roller bearing 56, which is provided with a projection 56*e*, the axial line of which coincides with that of the development roller 18. The projection 56*e* is kept pressured toward the axial line of the photoconductive drum 11. It is inserted in a groove 19*e* (which in this embodiment is an elongated straight hole, between the long edges of which the axial line of the photoconductive drum 11 falls) of the second end cover 19, being enabled to be moved toward the axial line of the photoconductive drum 11. In the groove 19*e*, a developing apparatus pressing spring (unshown) is disposed in a manner to press the projection 56*e*. The developing apparatus pressing spring is a spring for pressing a spacer ring 18*b*, the radius of which is approximately 300 $\mu$m greater than that of the development roller 18, and which is fitted around each of the lengthwise end portions of the development roller 18, upon the portion of the peripheral surface of the photoconductive drum 11, outside the image formation range.

The groove 19*e* also bears a role of regulating the direction in which the development roller 18 moves. As driving force is transmitted to the cartridge 15, the drum gear 33*c* (FIG. 22) attached to one of the lengthwise ends of the photoconductive drum 11, and the gear 54 attached to the lengthwise end of the development roller 18, on the same side as the drum gear 33*c*, mesh with each other, and the driving force causes the drum holding frame 13 and developing means holding frame 17 to pivot about the axial line of the hole 17*a* in the direction to make the two gears mesh more deeply with each other; the driving force does not act in the direction to cause the photoconductive drum 11 and development roller 18 to separate from each other. In addition, the development roller 18 is kept pressured toward the photoconductive drum 11 by the developing means holding frame pressing spring (unshown). With the employment of this structural arrangement, a predetermined amount of gap is maintained between the developing means holding frame 17 and drum holding frame 13.

In this embodiment, the gap between the units G and H is sealed with a sealing member, which is shaped like bellows, and is formed of the jointing sheet 21 in the following manner: The jointing sheet 21 is folded into two sections, which are pasted to the developing means holding frame 17 and developer holding frame 16, one for one, with the interposition of a jointing plate 24. The thickness of the jointing sheet 21 in this embodiment is no more than 1 mm. However, it may be more than 1 mm as long as such a material that does not make the resultant bellows inflexible is selected.

Figure 14:
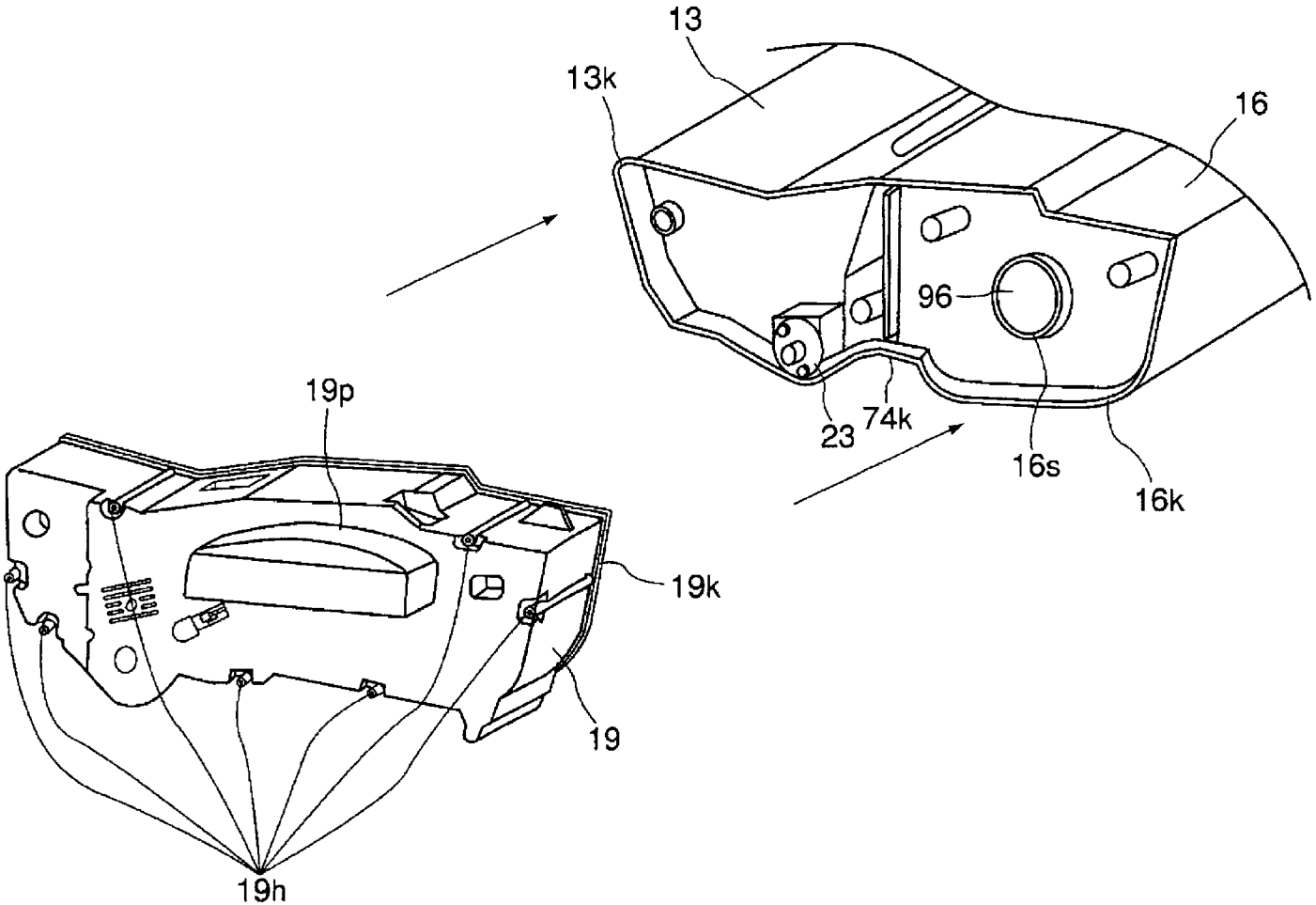
FIG. 14 is a perspective view of the end cover and corresponding lengthwise ends of the drum holding frame and developer holding frame, at one of the lengthwise ends of the process cartridge, for showing the method for attaching the end cover.

Next, referring to FIG. 14, the drum holding frame 13, developer holding frame 16, cover 74, and end cover 19 are joined together by flowing melted resin from the gate 19*h* of the end cover 19 into the channel formed between the inward edge 19*k* of the end cover 19, and the combination of the outward edges 13*k* and 16*k* of the drum holding frame 13 and developer holding frame 16, respectively, and outward edge 74*k* (FIG. 7) of the cover 74 (unshown in FIG. 14). The end cover 20 is also joined with the frames 13 and 16, and cover 74, in the same manner as the end cover 19, completing the cartridge 15.

Figure 19:
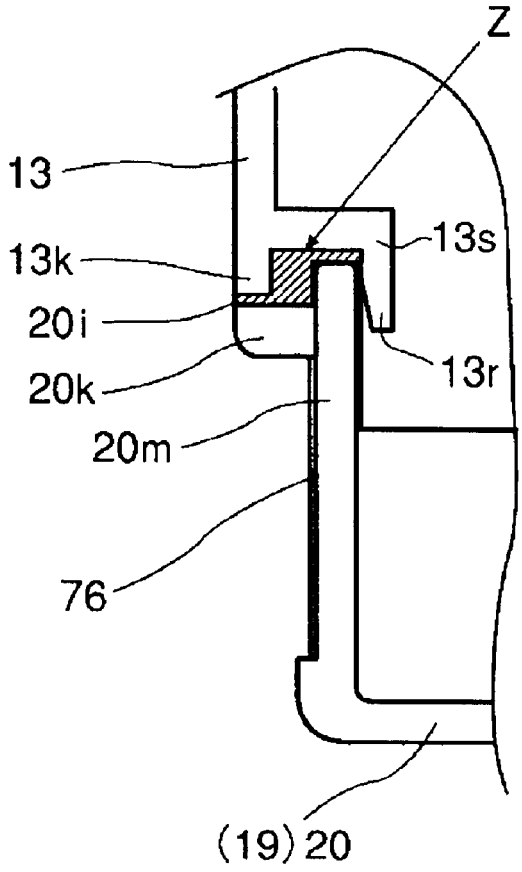
FIG. 19 is an enlarged sectional view of the joint between the side cover and cleaning means holding frame, on the same side as the side shown in FIG. 17.

FIG. 19 shows an example of the structure of a portion of the joint between the end cover and drum holding frame, across which the end cover and drum holding frame are welded to each other. The drum holding frame 13 is provided with a flange 13*s*, which is near the outward edge 13*k*, on the internal surface. The flange 13*s* is provided with a backup rib 13*r*. The end cover 20 is provided with a flange 20*k*, which is on the external surface, near the outward edge 20*m*. The flange 20*k* is positioned so that there will be a gap (joint 20*i*) between the flange 20*k* and inward edge 13*k* after the Joining of the drum holding frame 13 and end cover 20. This gap, or joint 20*i*, extends in the direction perpendicular to the plane of FIG. 19. The portion of the end cover 20 between the flange 20*k* and edge 20*m* is backed up by the backup rib 13*p*. The melted resin Z is flowed into the space formed by the edges 13*k* and 20*m*, and flanges 139 and 20*k*, and then is solidified.

As described above, the joint between the end cover 19 and the combination of the drum holding frame 13 and developer holding frame 16, and the joint between the end cover 20 and the combination of the drum holding frame 13 and developer holding frame 16, are provided with the above described structure. However, the structure is not extended throughout the joints; each joint is provided with a predetermined number of the above described structures, which are distributed throughout the joint, with the provision of appropriate intervals.

Figure 8:
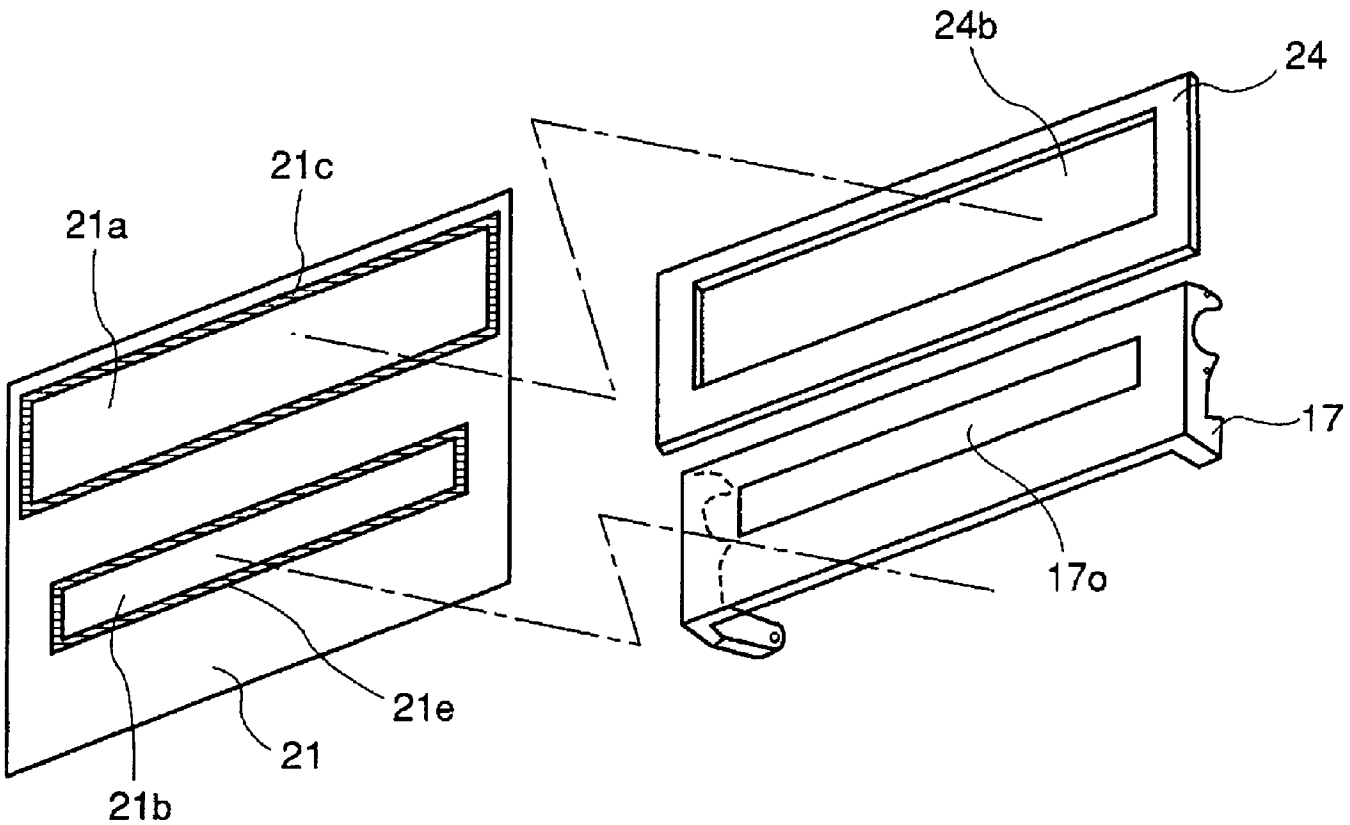
FIG. 8 is a perspective view of the sealing member, for showing the sealing member fabricating method.
Figure 9:
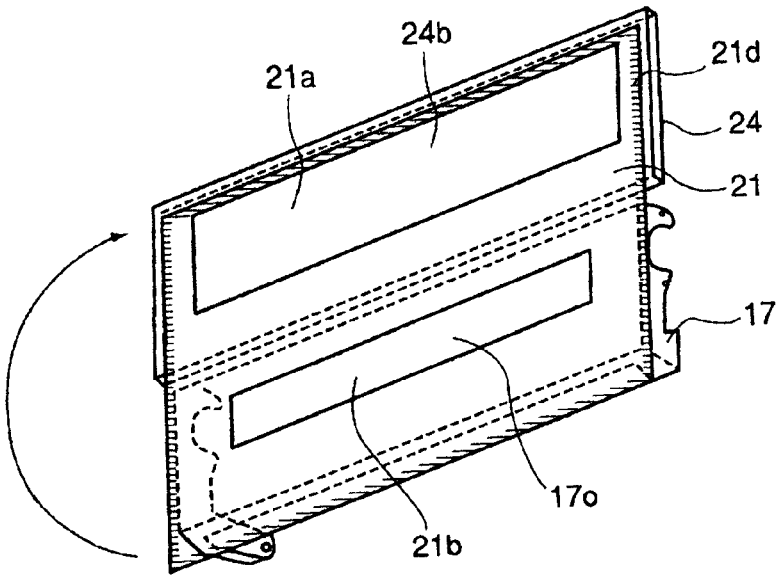
FIG. 9 is a perspective view of the sealing member, for showing the sealing member fabricating method.

Next, referring to FIGS. 8 and 9, a method for forming the pouch-like sealing member from the jointing sheet 21 is roughly described. Referring to FIG. 8, the jointing sheet 21 is provided with holes 21*a* and 21*b*, the sizes of which are approximately the same as, or greater than, those of the holes 24*b* and 17*o* of the jointing plate 24 and developing means holding frame 17, respectively.

The jointing sheet 21 is attached to the jointing plate 24 and developing means holding frame 17, by the edge portions 21*c* and 21*e* (hatched portions, which hereinafter will be referred to as joining portions), of the holes.

In this embodiment, the jointing sheet 21 is attached to the developing means holding frame 17 and jointing plate 24 by a thermal welding method, such as a thermal sealing method or an impulse sealing method. However, ultrasonic welding, adhesive, adhesive tape, or the like methods, may be used.

After being attached to the developing means holding frame 17 and jointing plate 24, the jointing sheet 21 is folded in the direction indicated by an arrow mark, as shown in FIG. 9, so that the holes 21*a* and 21*b* squarely face each other. Then, the two sections of the jointing sheet 21 created by the folding are attached to each other, by the edge portion 21 (hatched portion), creating a bellows-like (pouch-like) member. The means for attaching the above described two sections of the jointing sheet 21 may also be a thermal welding method such as a heat sealing method or an impulse sealing method, a ultrasonic welding, adhesive, adhesive tape, or the like.

Next, the jointing plate 24 is attached to the developer holding frame 16, leaving partially unwelded or unpasted to provide a gap through which a toner seal 63 can be passed.

In this embodiment, the jointing plate 24 is welded or pasted across the portion 24*a* shown in FIG. 7, but not across the portion across which the toner seal 63 is pressed down by a toner sealing member 95 (FIG. 7). The toner seal 63 is pasted to the developer holding frame 16, along the entirety of the edge of the developer delivery hole 16*d* of the developer holding frame 16, is folded back at the end cover 19 side, is doubled back to the end cover 20 side, and is extended outward through the gap between the sealing member 95 and developer holding frame 16.

The provision of the above described structural arrangement, in other words, the placement of the a pouch-like bellows formed of the jointing sheet 21 between the mutually facing surfaces of the developer holding frame 16 and developing means holding frame 17 minimizes the resistance which occurs as the distance between the mutually facing surfaces of the developer holding frame 16 and developing means holding frame 17 varies. Further, the placement of the jointing sheet 21 between the jointing plate 24 and developing means holding frame 17 makes it possible to attach the jointing plate 24 in a manner to cover the toner seal 63. With the provision of this arrangement, the toner sealing member 95 can be placed in the gap through which the toner seal 63 is passed, preventing toner leak.

The provision of the jointing plate 24 makes simpler the configuration of the welding table necessary for welding the jointing sheet 21 to the mutually facing surfaces of the developing means holding frame 17 and developer holding frame 16, compared to that necessary in the absence of the jointing plate 24, that is, when the jointing sheet 21 has to be directly pasted to the mutually facing surfaces of the developing means holding frame 17 and developer holding frame 16. Further, the provision of the jointing plate 24 makes it possible to assemble the developing means holding frame 17, jointing plate 24, and jointing sheet 21 into a unit which can be easily attached to the developer holding frame 16. The units G and H structured as described above are combined into the developing apparatus D.

Figure 25:
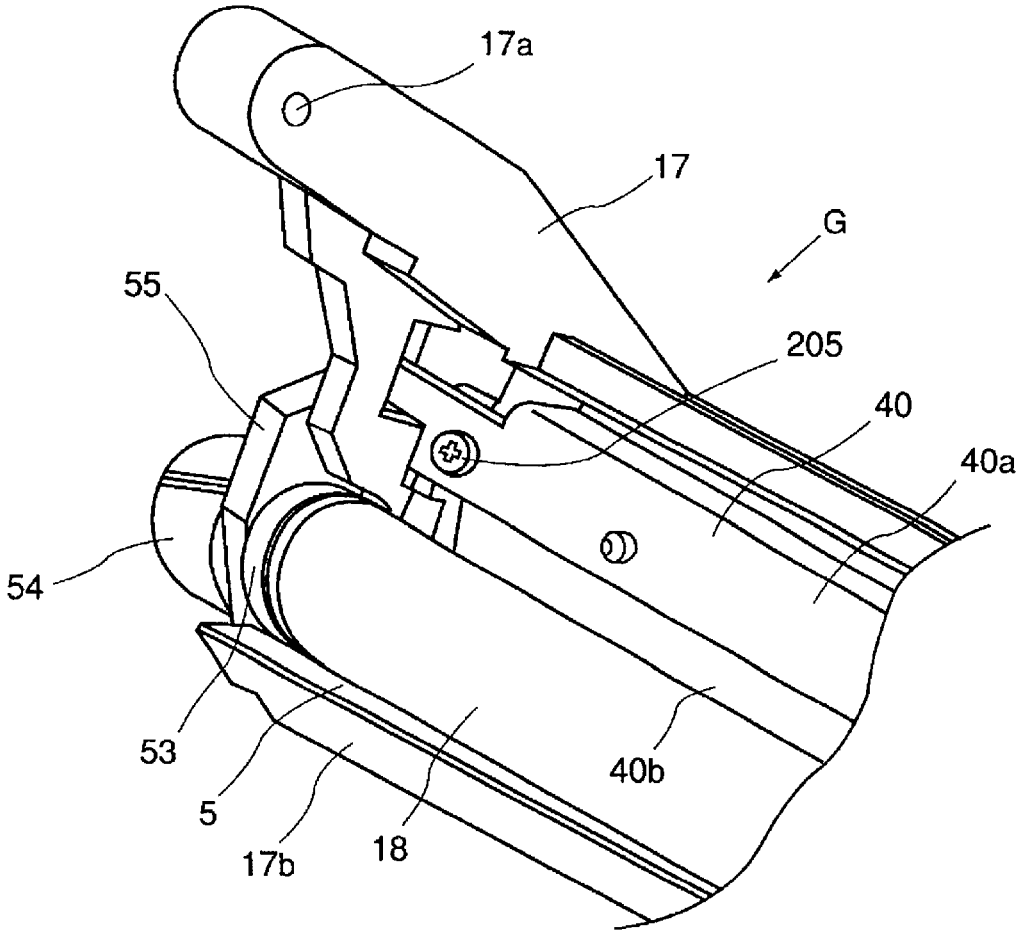
FIG. 25 is a perspective view of one of the lengthwise ends of the development unit, before disassembly.
Figure 26:
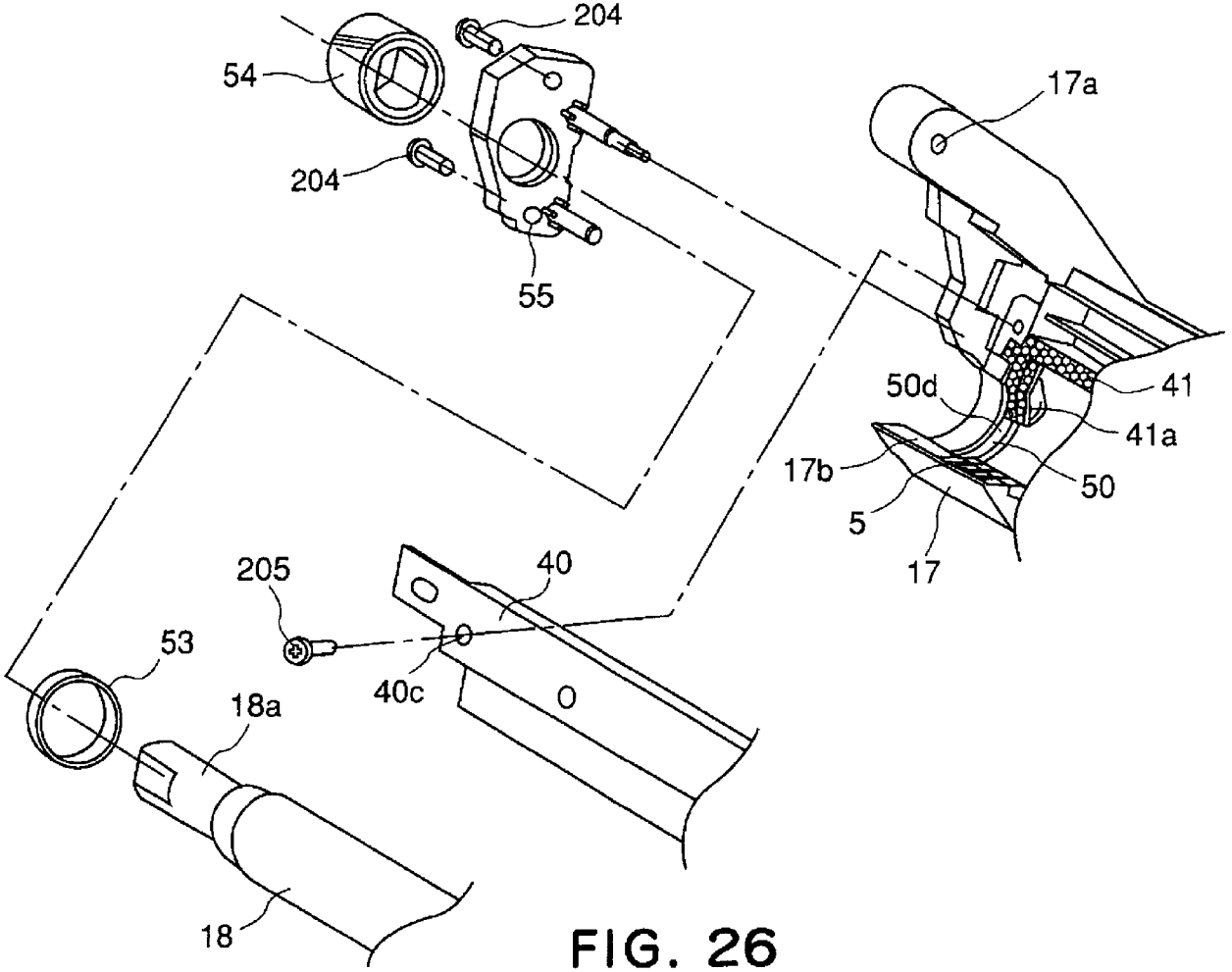
FIG. 26 is an exploded perspective view of the development unit, for showing the method for disassembling the development unit.

Referring to FIG. 26, the gap between the development roller 18 and the developing means holding frame 17 is sealed with a pair of magnetic seals 50, the rubber blade 40*b* of the development blade 40, and a blowout prevention sheet 5. The magnetic seals 50 seal the ranges corresponding to the lengthwise end portions of the development roller 18, one for one, whereas the rubber blade 40*b* of the development blade 40 and blowout prevention sheet 5 seal the range corresponding to the portion of the development roller 18 between the lengthwise end portions, by being placed in contact with the peripheral surface of the development roller 18 with the generation of a light contact pressure, as shown in FIG. 25. Between the metallic plate 40*a* of the development blade 40 and the developing means holding frame 17, an elastic seal 41 is provided as shown in FIG. 26. Each of the lengthwise ends of the elastic member 41 is provided with a portion 41*a*, which extends downward and contacts the lateral surface of the magnetic seal 50. The blowout prevention seal 5 is pasted to the top surface of the mandible-like portion 17*b* of the developing means holding frame 17.

With the provision of the above structural arrangement, toner does not leak from the developing apparatus D when the cartridge 15 is mounted into, or dismounted from, the apparatus main assembly C after the opening of the toner seal 63.

(Mounting or Dismounting of Process Cartridge into or out of Apparatus Main Assembly)

FIG. 2 is a sectional view of an image forming apparatus, in which the cartridge 15 is ready for image formation. In order to dismount the cartridge 15 in the state shown in FIG. 2, a lever (unshown) located on the front wall of the apparatus main assembly C is to be rotated. As the lever is rotated, an arm 4 is rotated in the direction indicated by an arrow mark (I). As a result, the left side of the cartridge 15, with reference to the drawing, is raised by a part (unshown) of the arm 4. As the left side of the cartridge 15 is raised, the cartridge 15 rotates, while being raised, about the guide portions 19*g* and 20*g* (FIGS. 6 and 5) rested on the guide rails 111 of the apparatus main assembly C, until the guide portions 19*f* and 20*f* (FIGS. 5 and 6) align with the guide rails 112 of the apparatus main assembly C. In this state, the cartridge 15 is to be pulled toward the front side of the apparatus main assembly C, in the direction perpendicular to the plane of the FIG. 1. As the cartridge 15 is pulled, the guide portions 19*f* and 20*f* transfer onto the guide rails 112, and the cartridge 15 becomes disengaged from the cartridge pressing portion 4*a* of the arm 4. Then, the cartridge 15 can be pulled straight out of the apparatus main assembly C.

The procedure for mounting the cartridge 15 into the apparatus main assembly C is reverse to the above described dismounting procedure. In other words, the cartridge is to be inserted into the apparatus main assembly C, with the guide portions 20*f* and 20*g* aligned with the rails 112 and 111, in the direction perpendicular to the plane of the FIG. 1. As the cartridge is inserted inward of the apparatus main assembly C, the top left portion of the cartridge 15 is caught by the arm 4 before the guide portion 20*f* becomes disengaged from the rail 112. Then, as the cartridge 15 is pushed further into the apparatus main assembly C, the guide portion 20*f* disengages from the rail 112. As the guide portion 20*f* disengages from the rail 112, the guide portion 19*f* aligns with the missing portion (unshown) of the rail 112, and the guide portion 19*g* is rested on the rail 111. Then, a lock (unshown) of the arm 4 is to be disengaged, and the aforementioned lever (unshown) on the front side of the apparatus main assembly C is to be rotated to rotate the arm 4 in the direction opposite to the direction indicated by the arrow mark (I). The rotation of the arm 4 is assisted by the weight of the cartridge 15 itself. As the arm 4 is rotated, the guide portion 19*f* moves downward through the aforementioned missing portion (unshown) of the guide rail 112.

As the cartridge 15 approaches the position at which the cartridge can form an image, the drum shaft 23 (FIGS. 3 and 6) protruding outward of the end cover 19, through the aforementioned hole 19*a* of the end cover 19, shown in FIG. 3, fits into the drum shaft positioning recess (unshown) of the apparatus main assembly C, being therefore accurately positioned (drum bearing 22 on the first end cover 20 side protrudes outward through the hole 20*a* of the end cover 20 (FIGS. 4 and 5)). As a result, the photoconductive drum 11 is accurately positioned relative to the apparatus main assembly C, because the axial lines of the photoconductive drum 11, drum bearing 22, and drum shaft 23 coincide. At this point, the front cover (unshown) of the apparatus main assembly C is to be closed. As the front cover is closed, a drive shaft (unshown) connected to the mechanical power source of the apparatus main assembly C is moved forward by the movement of the front cover C, causing the driving force transmitting portion located at the end of the drive shaft, to engage with the driving force receiving portion 33*a* of the drum flange 33 (FIG. 22) solidly fixed to the lengthwise end portion of the photoconductive drum 11. As a result, it becomes possible to drive the cartridge 15.

With the provision of the above described structural arrangement, even a process cartridge (15), which is heavy because of a large amount of toner T contained in the developer storage portion 16, can be smoothly mounted into, or dismounted from, the apparatus main assembly C. Incidentally, the cartridge 15 is also provided with a handle 19*p* (FIG. 6), in addition to the handle 35 on the top surface. The handle 19*p* is attached to the second end cover 19, being on the front side in terms of the direction in which the cartridge 15 is mounted or dismounted. The provision of the additional handle 19*p* makes it easier to carry the cartridge 15, and also to handle the cartridge 15 at the beginning of the mounting of the cartridge 15 or the end of the dismounting of the cartridge 15.

(Description of Toner Storage Unit)

Figure 10:
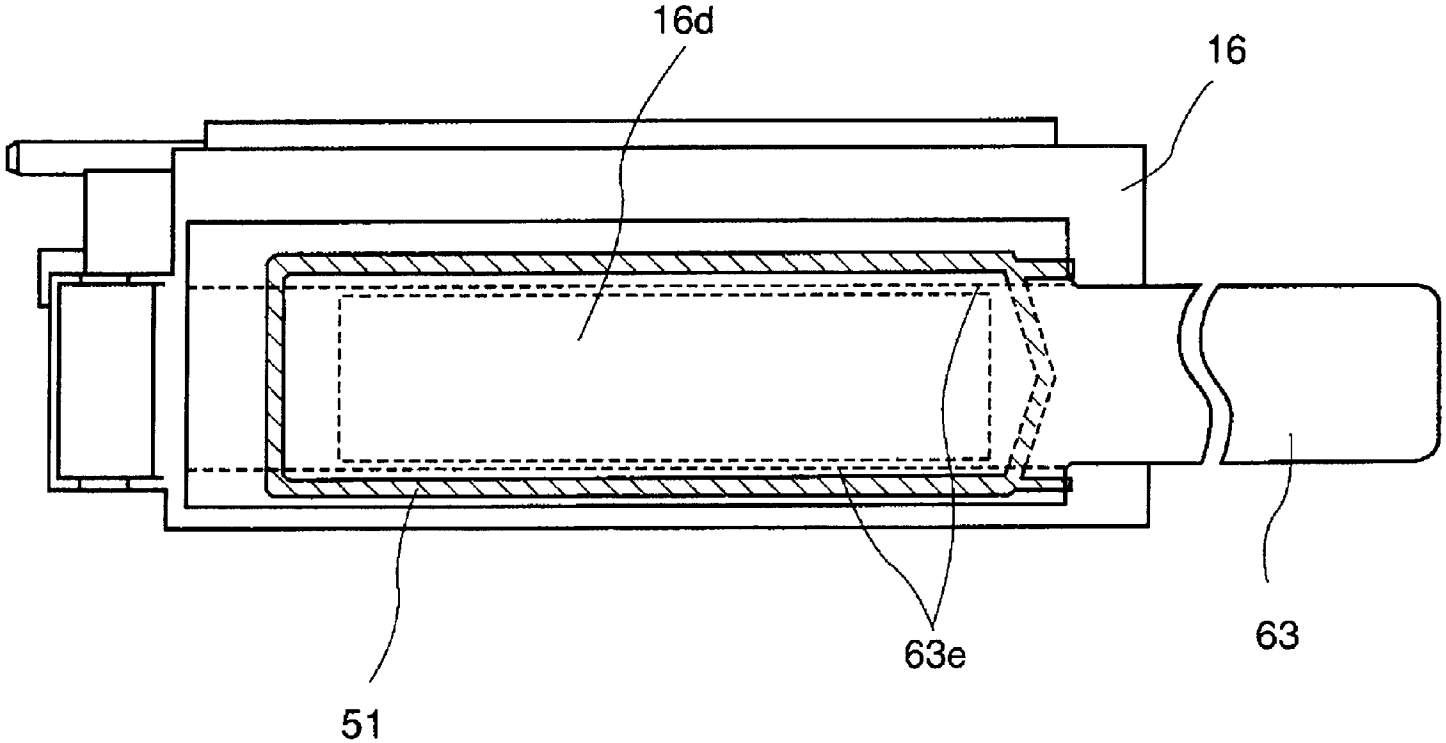
FIG. 10 is a drawing for showing how the toner seal seals the developer holding frame.
Figure 12:
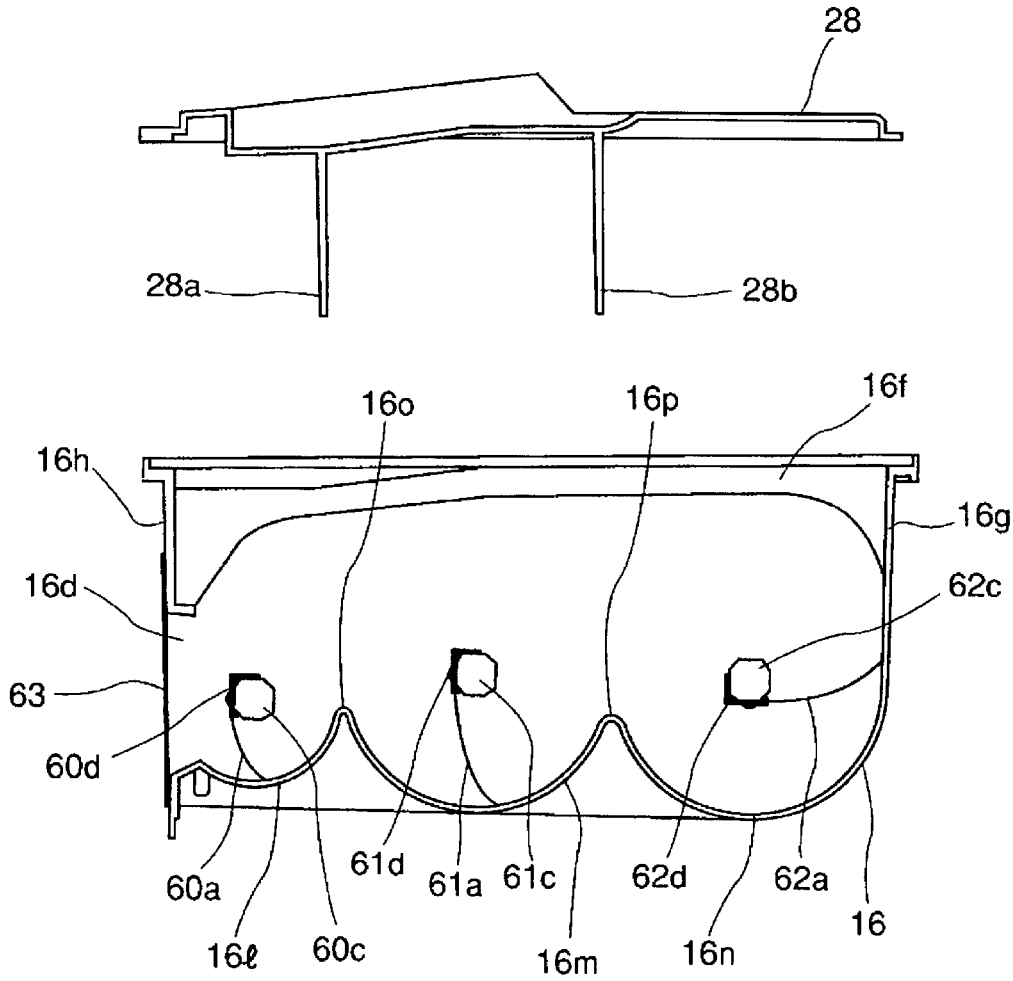
FIG. 12 is a sectional view of the developer holding frame, before welding.
Figure 13:
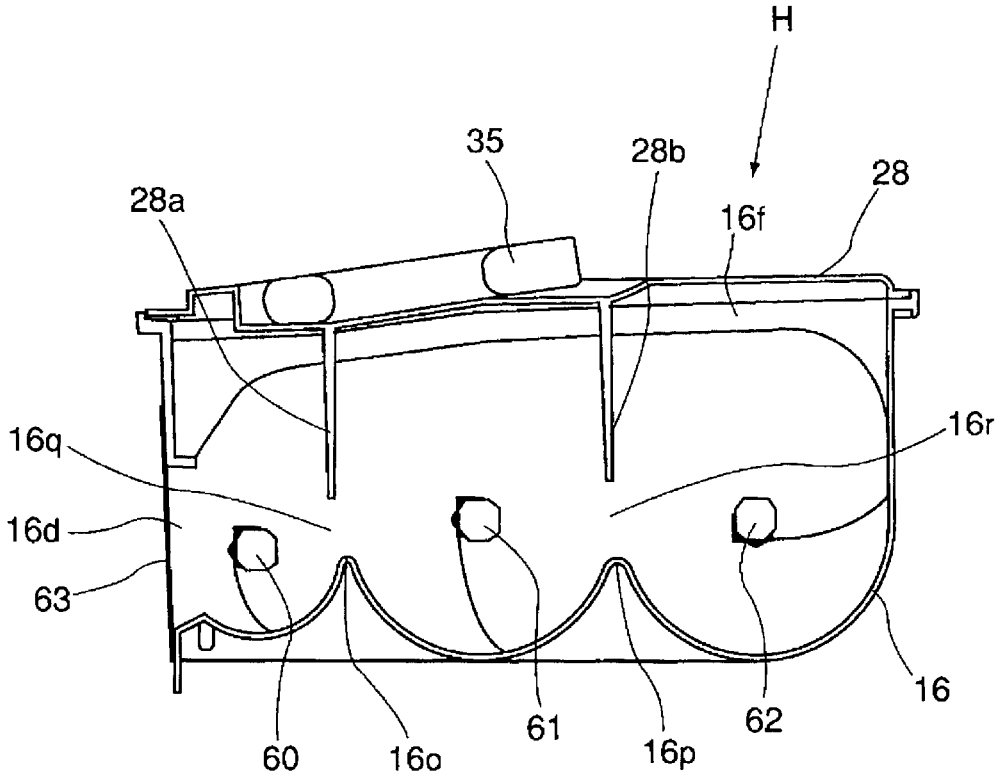
FIG. 13 is a sectional view of the developer holding frame, after welding.

Next, referring to FIGS. 10, 11, 12, and 13, the toner storage unit H will be described. The unit H comprises the developer holding frame 16, toner storage lid 28, and stirring members 60, 61, and 62. Referring to FIGS. 1 and 13, the developer holding frame 16 is provided with the developer delivery hole 16*d* through which the toner T is sent out to the developing means holding frame 17. The hole 16*d* is covered with the seal 63, which is thermally welded to the developer holding frame 16, along the surrounding edge of the hole 16*d* (FIG. 10). The seal 63 is opened when a new cartridge (15) is used for the first time. A referential code 51 stands for the welded portion (hatched portion).

The toner seal 63 in this embodiment has a laminar structure, having:

- a 12 μm thick polyester layer (strength providing layer: 63*i* in FIG. 11)
- a 7 μm thick aluminum foil layer (laser beam blocking layer: 63*i* in FIG. 11)
- a 50 μm thick polyester layer (tear guiding layer: 63*k* in FIG. 11), and
- a 50 μm thick sealant layer (adhesive layer: 63*l* in FIG. 11), listing from the top layer.

Tear lines 63*e* of the seal 63, along which the seal 63 is torn open, have been subjected to a laser-cut process for creating gaps in the tear guiding layer, along the tear lines 63*e*.

Figure 11:
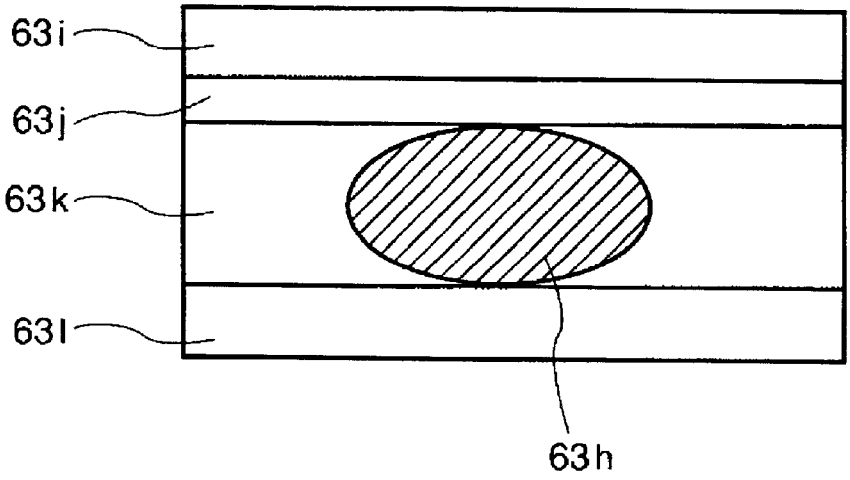
FIG. 11 is a sectional view of the toner seal.

FIG. 11 is a sectional view of the seal 63. The seal 63 has a gap 63*h* created by a laser. The provision of the aluminum foil layer which blocks a laser beam prevents the top polyester layer, or the strength providing layer 63*i*, from being damaged by the laser beam, assuring satisfactory sealing performance. The provision of the aluminum foil layer also causes the stress to concentrate to the gap 64*h* when the seal 63 is pulled to be opened, ensuring that the seal 63 is torn along the tear lines 63*e*.

Referring to FIG. 13, within the developer holding frame 16, the stirring members 60, 61, and 62 are provided, which send the toner T to the developing means holding frame 17 through the toner delivery hole 16*d*, while stirring the toner T. Referring to FIG. 12, the stirring members 60, 61, and 62 comprise: shaft 60*c*, 61*c*, and 62*c*; stirring blades 60*a*, 61*a*, and 62*a*; and blade holders 60*d*, 61*d*, and 62*d*, by which the stirring blades 60*a*, 61*a*, and 62*a*, are held to the shafts 60*c*, 61*c*, and 62*c*, respectively. In this embodiment, the blade 60*a* is formed of 50 μm thick PPS sheet, and blades 61*a* and 62*a* are formed of approximately 100 μm thick PPS sheet. The stirring members 60, 61, and 62 all rotate in the same direction (clockwise in FIG. 12). The stirring member 60, that is, the stirring member nearest to the developing means holding frame 17 rotates at approximately 20 rpm, and the other two stirring members 61 and 62 rotate at approximately 5 rpm.

Also referring to FIG. 12, the bottom wall of the developer holding frame 16 is shaped so that its cross section looks as if it is made by connecting three semicircles: 16*l*), 16*m*, and 16*n*, the centers of which coincide with the axial lines of the shafts 60*c*, 61*c*, and 62*c*, respectively. The distances from the axial lines of the shafts 60*c*, 61*c*, and 62*c* to the tips of the blades 60*a*, 61*a*, and 62*a*, when the blades are straight, are made greater than the radii of the semicircular portions 16*l*, 16*m*, and 16*n*, respectively, making it possible for the blades 60*a*, 61*a*, and 62*a* to stir the toner T while scraping the bottom wall of the developer holding frame 16. Therefore, even after the remaining amount of the toner T becomes small due to toner delivery, the blades can scrape the toner T away from the bottom wall, and send to the developing means holding frame 17, reducing the amount of the unusable toner, or the toner T which fails to be delivered and remains in the developer holding frame 16.

In this embodiment, the distances the blades 60*a*, 61*a*, and 62*a* hypothetically invade into the semicircular portions 16*l*, 16*m*, and 16*n*, respectively, of the bottom wall are 2–4 mm.

Again referring to FIG. 12, within the developer holding frame 16, a bridge-like rib 16*f* is provided, which extends from the internal surface of the wall 16*h* to which the aforementioned jointing plate 24 is attached in a manner to cover the hole 16*d*, to the rear wall 16*g*, in terms of the cartridge 15 mounting direction, of the developer holding frame 16. The bottom edge of the rib 16 is contoured so that it does not interfere with the installation of the stirring member 60 into the developer holding frame 16, and the top edge of the rib 16 is contoured so that it does not interfere with the toner storage lid 28.

The lid 28 is provided with isolation ribs 28*a* and 28*b*, which extend in the lengthwise direction of the cartridge. In terms of the direction perpendicular to the lengthwise direction of the cartridge 15, the positions of the isolation ribs 28*a* and 28*b* virtually coincide with the position of the joint 16*o* between the semicircular portions 16*l* and 16*m*, and the position of the joint 16*p* between the semicircular portions 16*m* and 16*n*, of the bottom wall of the developer holding frame 16. In order for the ribs 28*a* and 28*b* not to interfere with the rib 16*f* within the developer holding frame 16, the center portions 28*c* of the rib 28*a* and 28*b* have been cut out (FIG. 7).

After the installation of the stirring members 60, 61, and 62 into the developer holding frame 16, the lid 28 and developer holding frame 16 are welded to each other by ultrasonic welding or vibration welding, completing the toner storage unit H. The gaps 16*q* and 16*r* left between the ribs 28*a* and 28*b* and the protruding joints 16*o* and 16*p* are the gaps necessary for sending out the toner T. In this embodiment, the gaps are approximately 10 mm–16 mm wide (FIG. 13).

After assembling the unit H as described above, the developer holding frame 16 is filled with the toner T through the toner inlet 16*s*, and is sealed with a toner cap 96. As a result, the developer storage portion 16A of the unit H is filled up with the toner T.

[Process Cartridge Remanufacturing Method in Accordance with Present Invention]

Next, referring to FIGS. 15–19, a method for overhauling the cartridge 15 in this embodiment will be described.

(Process for Removing Drum Shutter)

Figure 15:
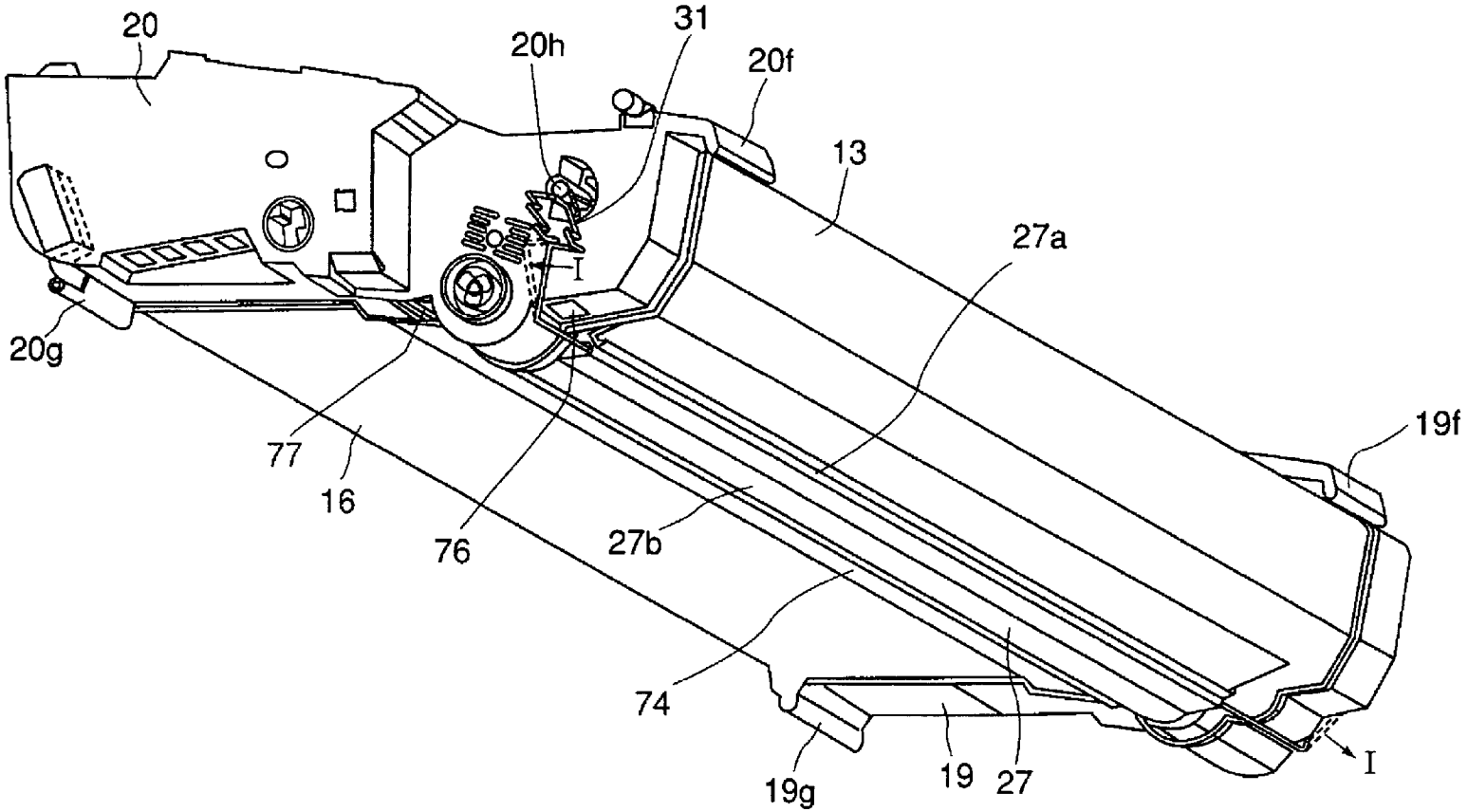
FIG. 15 is a perspective view of the process cartridge as seen from diagonally below.

Referring to FIG. 15, first, the drum shutter 27 is removed. More specifically, first, a torsion coil spring (unshown) must be removed. The torsion coil spring is fitted around the center shaft 20*h* of the end cover 20, by which the shutter 27 is rotationally supported. The torsion coil spring has been twisted so that the shutter 27 is kept pressured in the direction to cover the photoconductive drum 11 (unshown in FIG. 15). Next, in order to extract the shutter shaft 31, which is supporting the shutter 27, from the shutter shaft supporting portion (unshown part of drum holding frame), the shaft 31 must be bent in the direction indicated by an arrow mark (I), that is, in the direction to stretch the shutter shaft 31, against the its resiliency. Then, the shaft 31 is pulled out of the supporting portion. The shutter 27 is rotationally connected to the shaft 31; the cover portion 27*b* of the shutter 27 is rotationally connected to the shaft 31, by the long edge portion 27*a*. Therefore, as the shaft 31 is removed, the entirety of the shutter 27 becomes disengaged from the drum holding frame 13. Further, the shaft 31 is formed of a piece of springy wire. Therefore, even after it is deformed to a certain degree for its removal, it can be reused. The shutter 27, torsional coil spring (unshown), and the like, are cleaned and examined. Among these components, those determined to be reusable are reused.

(Process for Removing End Covers)

Figure 16:
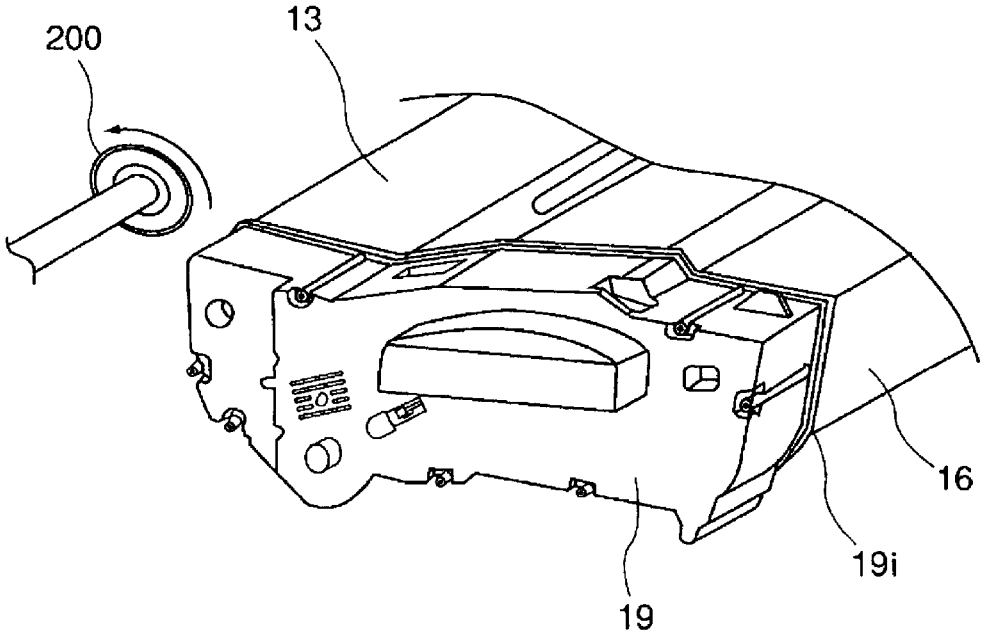
FIG. 16 is a perspective view of the end cover and corresponding lengthwise ends of the drum holding frame and developer holding frame, shown in FIG. 14, for showing the method for cutting off the end cover.

Next, the end covers 19 and 20 are removed from the lengthwise end of the cartridge 15. FIG. 16 shows the method for separating the second end cover 19.

First, the cartridge 15 is secured to a chuck (unshown) of a milling machine. Then, a milling cutter 200 is positioned in a manner to cut into one of the welded portions 19*i* of the seam between the inward edge of the end cover 19 and outward edge of the drum holding frame 13, or the seam between the inward edge of the end cover 19 and outward edge of the developer holding frame 16, and is moved along the inward edge of the end cover 19, cutting through the welded portions 19*i*. As a result, the end cover 19 is released from the drum holding frame 13 and developer holding frame 16. FIG. 19 shows one of the welded portions 20*i* of the seam between the end cover 20 and drum holding frame 13. Since the welded portions 20*i* of the seam between the end cover 19 and drum holding frame 13 is the same (having no electrode) as the welded portions of the seam between the end cover 20 and drum holding frame 13, the welded portions 20*i* of the seam between the end cover 19 and drum holding frame 13 will be described with reference to FIGS. 19 and 20. The welded portion 20*i* comprises the outward edge 13*k* of the drum holding frame 13, the inward surface of the tip of the flange 20*k* of the end cover 19, solidified resin, and inward edge 20*m* of the end cover 19. The backup rib 13*r* does not need to be cut, but may be cut. In this embodiment, a milling cutter is used for cutting, but a ultrasonic cutter, a heated blade, a rotating blade other than a milling cutter, or the like, may be used as the tool for removing the end covers 19 and 20. Next, the end cover 19 is removed from the main assembly of the cartridge 15. As for the choice of the milling machine for cutting the welded portion 19*i*, an NC milling machine is most suitable.

Figure 17:
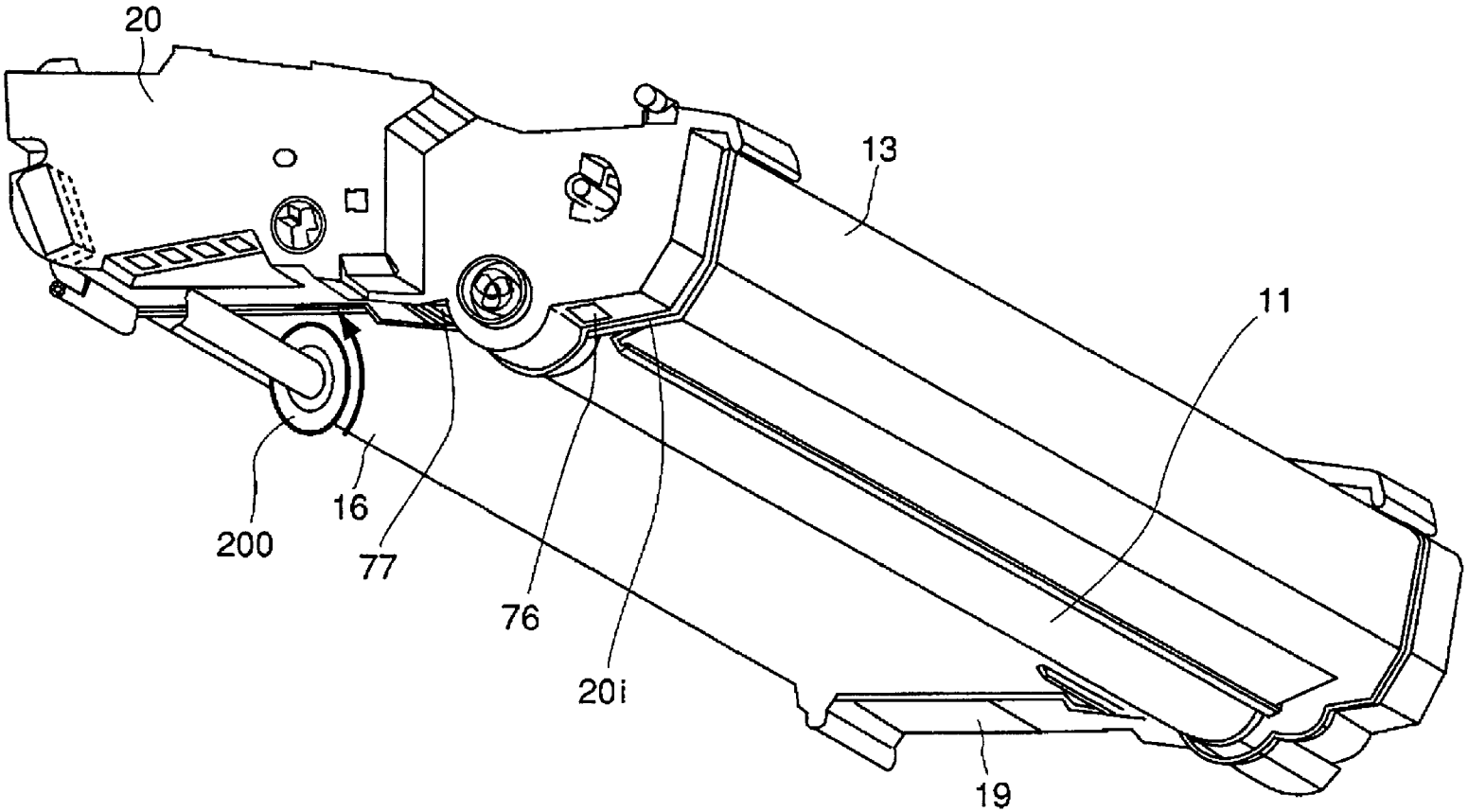
FIG. 17 is a perspective view of the end cover and corresponding lengthwise ends of the drum holding frame and developer holding frame, at the other lengthwise end of the process cartridge, for showing the method for cutting off the end cover at the same end.
Figure 18:
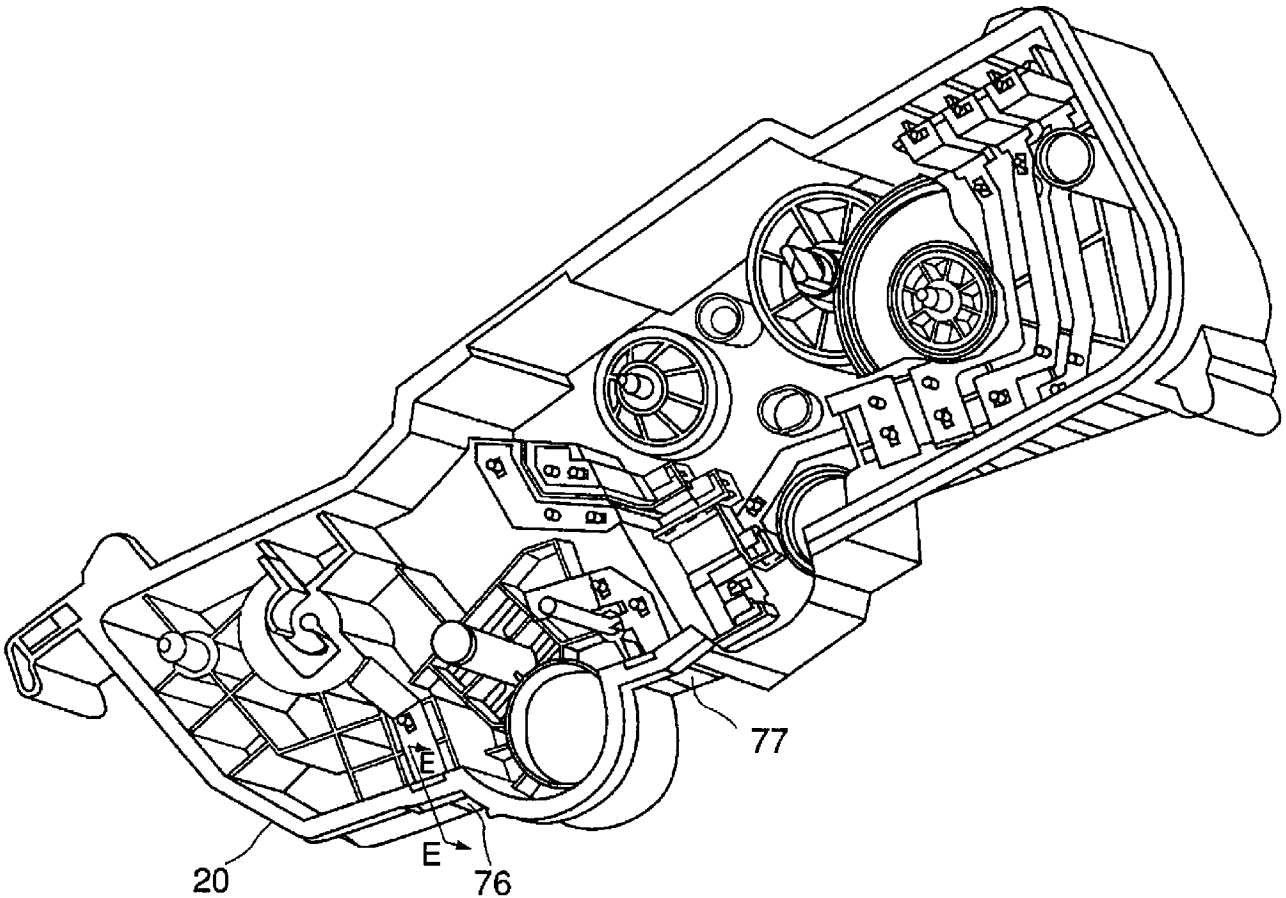
FIG. 18 is a perspective view of the inward side of the end cover shown in FIG. 17.
Figure 20:
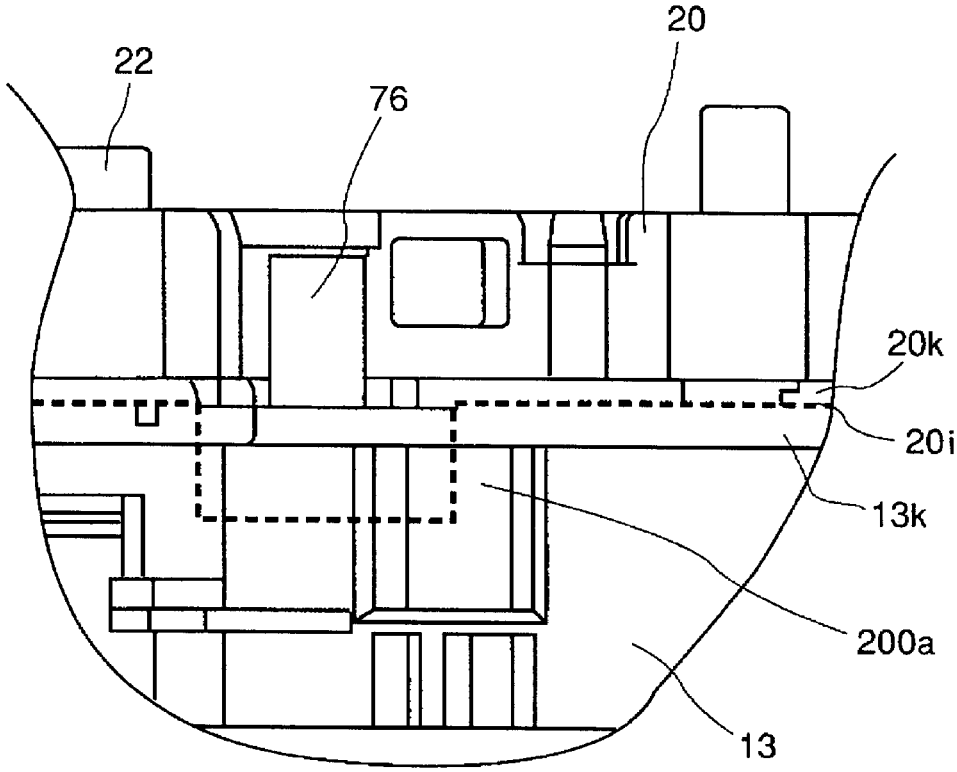
FIG. 20 is an enlarged plan view of the charge voltage contact plate on the bottom surface of the side cover, and its adjacencies, on the same side as the side shown in FIG. 17.

Next, the first end cover 20 on the other lengthwise end of the cartridge 15 is removed. The method for removing the first end cover 20 is basically the same as that for the second end cover 19, as shown in FIG. 17, except for one important point. The end cover 20 is provided with a charge voltage contact plate 76 and a development voltage contact plate 77, which are for supplying high voltage from the apparatus main assembly C to the development roller 18 and charge roller 12, respectively, and are exposed from the bottom surface of the end cover 20. The charge voltage contact plate 76 and development voltage contact plate 77 are shown in FIGS. 18, 19, and 20. FIG. 19 is a sectional view of one of the welded portions of the seam between the end cover 20 and drum holding frame 13, at the plane E—E in FIG. 18, and FIG. 20 is an enlarged plan view of the charge voltage contact plate 77 and its adjacencies, as seen from below. As shown in the drawings, the contact plates 76 and 77 are solidly fixed to the end cover 20 by flowing the melted resin Z into the space (hatched portion in FIG. 19) in the joint between the end cover 20 and drum holding frame 13. Thus, if the milling cutter is moved following the welded portion 20*i*, the charge voltage contact plate 76 is cut. In order to avoid this problem, the milling cutter must be moved along a cutting line 200*a* indicated by a broken line in FIG. 20. In other words, the welded portion 20*i* must be cut so that the charge voltage contact plate remains attached to the first end cover 20.

(Process for Separating Drum Supporting Frame)

Figure 21:
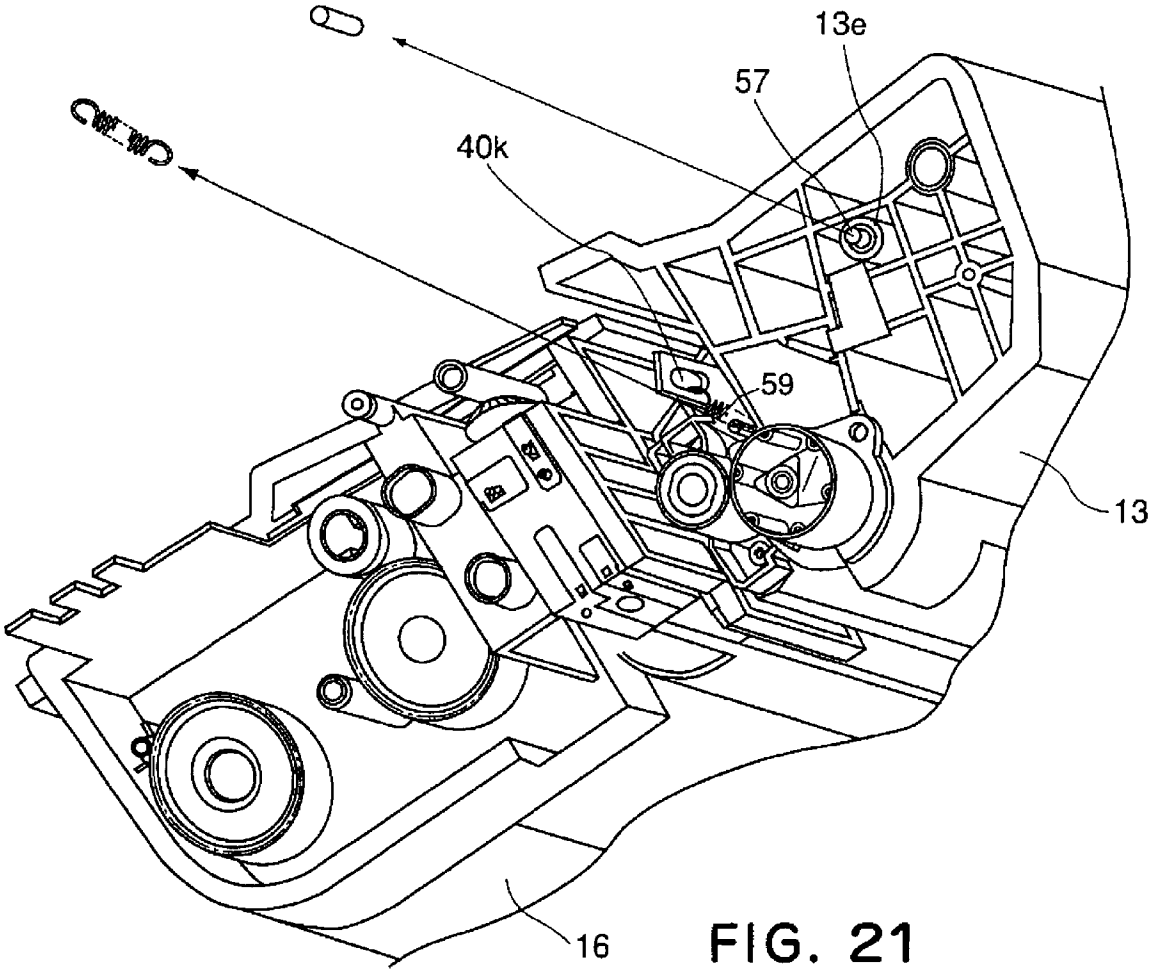
FIG. 21 is a perspective view of the lengthwise ends of the cleaning unit and developing apparatus, at one of the lengthwise ends of the process cartridge, for showing how the two units are separated from each other.

The process which follows the process for removing the end covers 19 and 20 as described above is the process for separating the drum holding frame from the developing means holding frame. On the non-driven side, as the end cover 19 is removed, the projection 56*e* of the development roller bearing 56 solidly fixed to the developing means holding frame 17 comes out of the groove 19*e* of the second end cover 19, allowing the drum holding frame 13 to be separated from the developing means holding frame 17. On the driven side, the tension coil spring 59 stretched between the hole 40*k* of the metallic plate 40*a* of the development blade 40 and the dowel (unshown) of the drum holding frame 13 is removed, as shown in FIG. 21, with the use of a pair of tweezers (unshown) or the like. Next, a pin 57 put through the hole 17*a* (unshown in FIG. 21) of the developing means holding frame 17 and the hole 13*e* of the drum holding frame 13 is pulled out by pinching its tip with a pair of pliers or the like, allowing the cleaning unit F and developing apparatus D to be separated from each other.

(Process for Reassembling Cleaning Unit)

Next, the various components of the cleaning unit F are examined and cleaned. Those not suitable for recycling are replaced. Further, the residual toner having been collected in the cleaning unit F is removed.

(Process for Removing Drum Shaft)

Referring to FIG. 22, the drum shaft 23, with which the photoconductive drum 11 is rotationally supported by the drum holding frame 13, is removed from the drum holding frame 13 by removing the small screws with which the drum shaft 23 is held to the drum holding frame 13.

(Process for Removing Drum Bearing)

There are no small screws to be removed to remove the drum bearing 22. The drum bearing 22 is in the form of a hollow cylinder, the internal circumference of which is equal to that of the hole 13*o* of the drum holding frame 13. It fits around the cylindrical portion (not visible in FIG. 22) of the drum flange 33 protruding outward of the end plate 130 of the drum holding frame 13, through the end plate 13*p*. After the removal of the drum bearing 22, there is a play between the drum flange 33 and the wall of the hole 13*o*.

Incidentally, the order in which the drum shaft removal process and drum bearing removal process were carried out may be reversed.

(Process for Removing Drum)

First, the cylindrical guide portion 32*b* of the drum flange 32, that is, the drum flange on the second end cover 19 side, of the photoconductive drum 11, is moved sideways following the U-shaped groove 13*t* in the inward surface of the end plate 13*p*, until the guide portion 32*b* slides out of the U-shaped groove 13*t*. Then, the photoconductive drum 11 is diagonally pulled out of the drum holding frame 13. The U-shaped groove 13*t* is for guiding the guide portion 32*b* so that the center hole 32*a* of the drum flange 32 approximately aligns with the hole 13*u* of the end plate 13*q* of the drum holding frame 13, through which the drum shaft 23 is put.

(Process for Removing Charge Roller)

The cleaning blade 14 attached to the inward side of the drum holding frame 13 is examined to determine whether or not it is damaged. If the cleaning blade 14 is damaged, first, the charge roller 12 is removed. Referring to FIG. 2, the charge roller bearing 12*a* is movably fitted in the guide way 13*d* of the drum holding frame 13, and the metallic core 12*c* of the charge roller 12 is rotationally fitted in the charge roller bearing 12*a*. Between the charge roller bearing 12*a* and the end portion of the guide way 13*d*, a compression spring 12*b* is disposed in the compressed state. Thus, the bearing 12*a* is removed from the guide way 13*d*, with the bearing 12*a* remaining attached to the charge roller 12.

(Process for Removing Cleaning Blade)

The cleaning blade 14 is removed after the small screws (unshown) holding the cleaning blade 14 are removed.

(Process for Removing Developer)

When the developer removed from the peripheral surface of the photoconductive drum 11 remains in the residual developer storage portion 13*c* of the drum holding frame 13 by a substantial amount, it is removed. More specifically, a suction nozzle (unshown) is inserted into the residual developer storage portion 13*c*, and the developer removed from the peripheral surface of the photoconductive drum 11 is suctioned out, and/or compressed air is blown into the residual developer storage portion 13*c*, so that the developer is suctioned, and/or blown, out of the storage portion 13*c*.

(Process for Attaching Cleaning Blade)

After the removal of the residual developer in the drum storage frame 13, a new cleaning blade, or a used cleaning blade 14 with no damage, is attached to the drum holding frame 13, with the use of small screws (unshown).

(Process for Attaching Charge Roller)

The removed charge roller 12 is examined for damage. When it is contaminated with the toner T, the toner T is wiped off. Next, the bearing 12*a* and spring 12*b* are attached to the charge roller 12, and the bearing 12*a* is fitted into the guide way 12*d* of the drum holding frame 13. If necessary, the components other than the above mentioned ones are also examined and cleaned.

(Process for Attaching Drum)

Next, a new photoconductive drum 11 is attached to the drum holding frame 13 following in reverse the steps followed for removing the old photoconductive drum 11. More specifically, one of the lengthwise ends of the new photoconductive drum 11 is put through the hole 13*o* of the drum holding frame 13 so that the driving force receiving portion 33*a* protrudes outward of the drum holding frame 13. Into the other lengthwise end, the drum shaft 23 is inserted from outside the drum holding frame 13, through the hole 13*u*. As a result, one of the lengthwise ends of the new photoconductive drum 11 is properly supported by the drum holding frame 13. Then, the drum bearing 22 is inserted into the journal portion 33*b* of the drum holding frame 13, and the hole 13*o* of the drum holding frame 13.

(Process for Overhauling Developing Apparatus)

Figure 23:
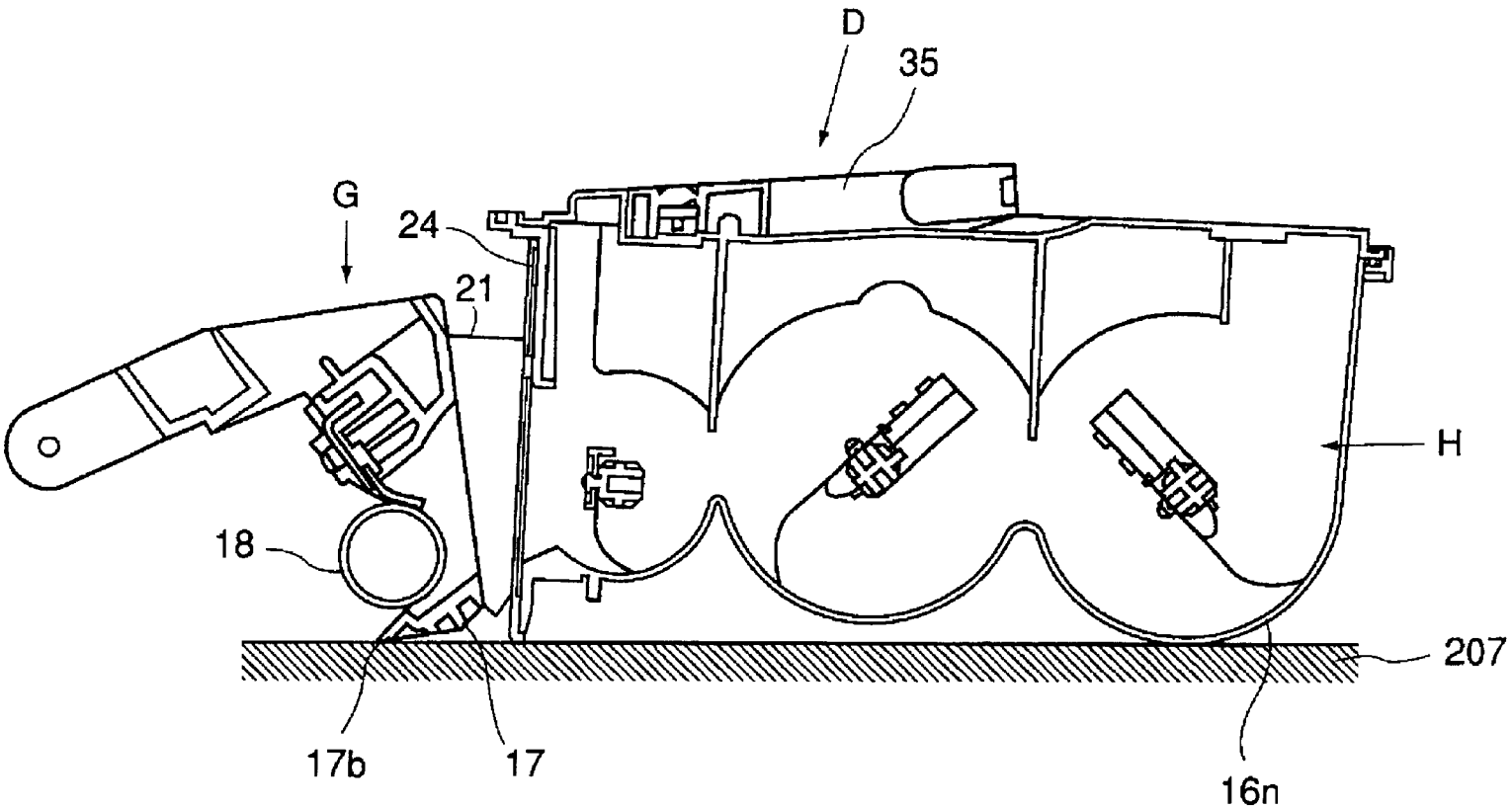
FIG. 23 is a sectional view of the development unit, for showing the method for protecting the jointing sheet when disassembling the development unit.
Figure 24:
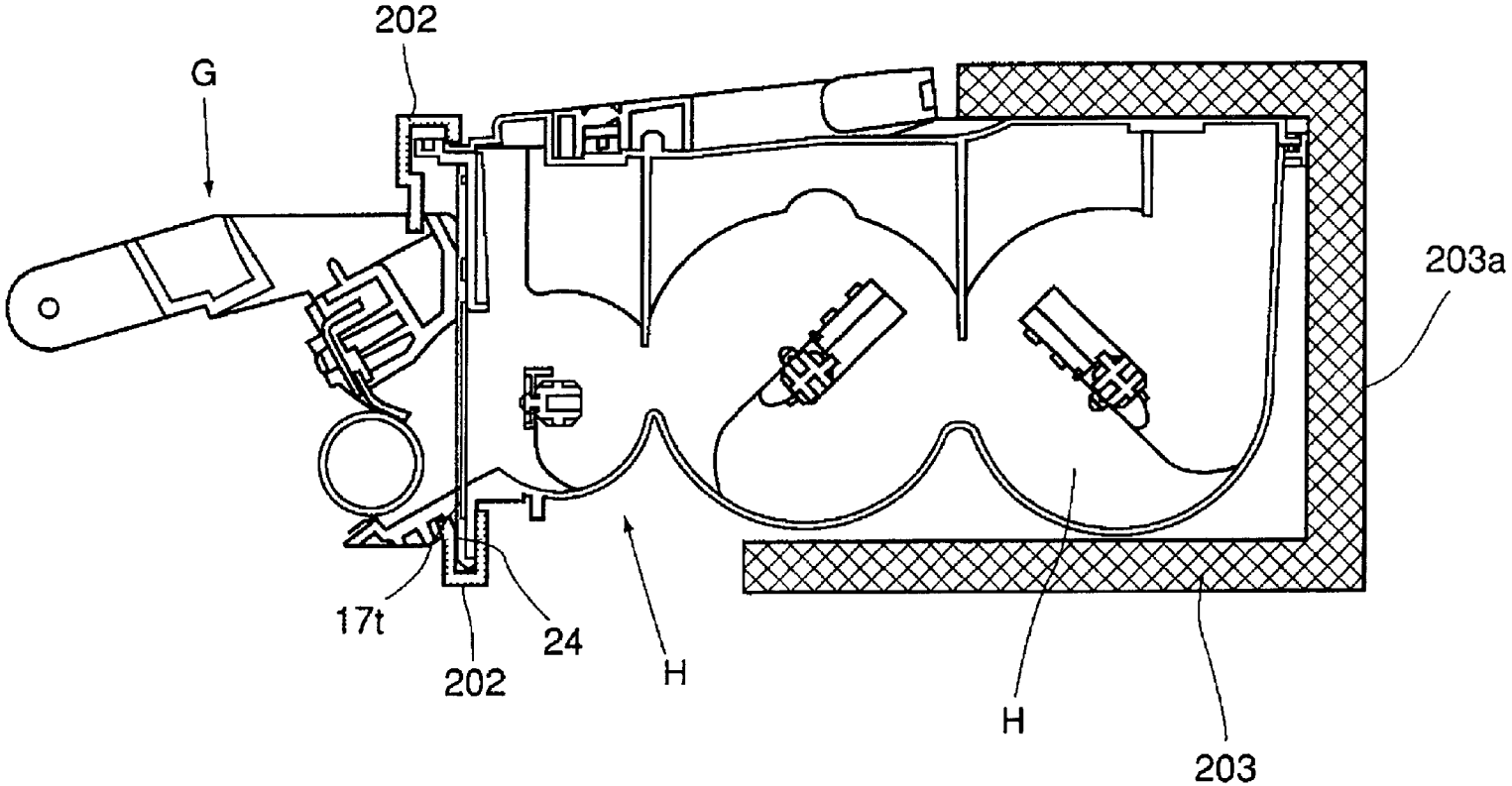
FIG. 24 is a vertical sectional view of the development unit, for showing the method for disassembling the development unit.

Next, the method for reassembling the developing apparatus D will be described. When reassembling the developing apparatus D, it is desired that, first, the jointing sheet 21 between the development unit G separated from the cleaning unit F, and the toner storage unit H, is protected so that it will not be damaged during the reassembly. For that purpose, the developing apparatus D is laid on its side on an assembly table 207, as shown in FIG. 23. With this placement of the developing apparatus D, the unit H is supported on the assembly table 207, by the semicylindrical portion 16*n* of the developer holding frame 16, and the bottom edge of the jointing plate 24. As a result, the development unit G tilts due to its own weight, with the mandible-like portion 17*b* (to which blowout prevention sheet is pasted) of the developing means holding frame 17 acting as a fulcrum, after coming into contact with the assembly table 207. As a result, the jointing sheet 21 is tensioned. As described before, the jointing sheet 21 is formed of a piece of thin sheet. Therefore, there is a possibility that the jointing sheet 21 will be torn even by a slight tension. Thus, in order to prevent the jointing sheet 21 from tearing, the developing means holding frame 17 and developer holding frame 16 are kept clamped together with the use of several clamping jigs 202 for clamping the developing means holding frame 17, which clamp onto the developing means holding frame 17, on the surface opposite to the surface 17*t* to which the jointing sheet 21 is welded, and the jointing plate 24 attached to the developer holding frame 16, on the surface opposite to the surface to which the jointing sheet 21 is welded, as shown in FIG. 24. This arrangement prevents the jointing sheet 21 from being tensioned or being torn by the other components. The above described clamping jigs 202 are U-shaped elastic clips. The developing apparatus D can be reassembled in this state. However, it is desired that the unit H is supported by a holding table 203 in order to make the reassembly easier. The table 203 is in the form of a container, and is configured so that the developer holding frame 16 perfectly, that is, immovably, fits in the table 203. The table 203 is made flat across the bottom surface 203*a* so that the table 203 remains stable on the assembly table. The components of the developing apparatus D are removed after the developer holding frame 16 is immovably set on the table 203.

FIG. 25 is an enlarged perspective view of one of the lengthwise ends of the development unit G prior to its disassembly, and FIG. 26 is an exploded perspective view of the portion of the development unit G shown in FIG. 25, for showing the procedure for disassembling the development unit G. The driven and non-driven sides of the development unit G are virtually symmetrical to each other. Therefore, only the procedure for disassembling the driven side will be described. First, the sleeve gear 54, which receives the driving force from the drum gear 33*c* solidly fixed to the lengthwise end of the photoconductive drum 11 (unshown in FIGS. 25 and 26) on the driven side, and rotationally drives the development roller 18, is disengaged from the flange 18*a* solidly fixed to one of the lengthwise ends of the development roller 18.

Next, referring to FIG. 26, two small screws, which are holding the development roller bearing 55 for rotationally supporting one of the lengthwise ends of the development roller 18, to one of the lengthwise ends of the developing means holding frame 17, are removed. Then, the bearing 55 is pulled away from the developing means holding frame 17; on non-driven side, the development roller bearing 56 shown in FIG. 7 is pulled away. Thereafter, the development roller 18 is moved out of the developing means holding frame 17 in the direction perpendicular to its axial direction, ending the process for removing the development roller 18.

Next, a small screw 205 in the developing means holding frame 17 put through the hole 40*c* of the development blade 40, is removed, and the development blade 40 is removed. Then, the removed development roller 18, bearing 55, and sleeve gear 54, development blade 40, are examined, as necessary, along with distance regulating members 53 fitted around the lengthwise end portion of the development roller 18 for regulating the distance between the development roller 18 and photoconductive drum 11. Then, they are divided into a group of those recyclable, and a group of those nonrecyclable. The recyclables are cleaned, as necessary, by a blower or the like. Those which do not pass the examination because their performances do not reach their set standards are replaced by new ones as necessary.

Regarding the seals and the like, which are not removed from the developing means holding frame 17, if any of them is broken, wrinkled, and/or sustains the like damages, it is replaced with a new one.

In this embodiment, a magnetic sealing method is employed as a means for sealing toner at the lengthwise ends of the development roller 18. Therefore, after the removal of the development roller 18, the internal surface 50*d* of the magnetic seal 50 is covered with the toner T. This interferes with the attachment of new components. Therefore, it is desired that the toner T on the internal surface of the magnetic seal 50 is removed by a vacuum cleaner or the like.

The developing apparatus D is reassembled following in reverse the steps taken for disassembling it, until it looks again as shown in FIG. 25.

(Process for Refilling Developer)

There are two methods for refilling the toner T.

Figure 27:
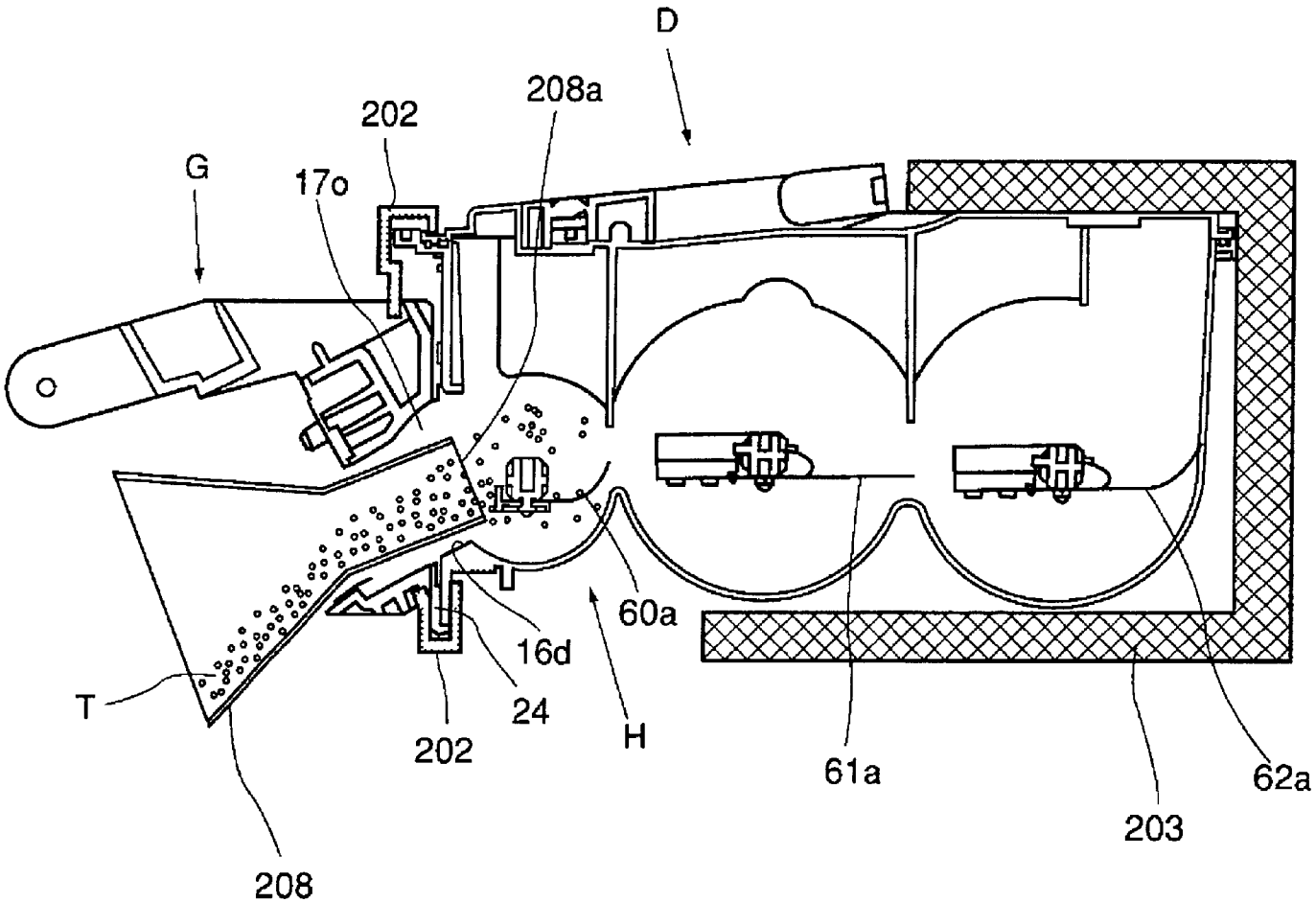
FIG. 27 is a sectional view of the developing apparatus and funnel, for showing the method for filling toner into the developer holding frame through the opening of the developing apparatus.

One method is as follows. After the removal of the various components of the developing apparatus D as described above, the toner T is filled by a necessary amount into the developer holding frame 16 through the gap between the units G and H, and the toner delivery hole 16*d*, as shown in FIG. 27. If necessary, a tool such as a funnel 208 or the like may be inserted into the hole 16*d*. This method makes it possible to refill the toner T during the aforementioned developing apparatus D reassembling sequence, improving reassembly efficiency.

The end portion 208*a* of the tool 208 is inserted into the unit H, making it less likely for the development unit G and its adjacencies to be contaminated by the toner T, and therefore, simplifying the cleaning thereafter. Further, in terms of the rotational phase, the blades 60*a*, 61*a*, and 62*a* are positioned so that the direction in which they extend in terms of their radial direction become parallel to the direction in which the toner T is flowed into the developer holding frame 16 (FIG. 17). Therefore, the toner T can be more efficiently filled. After the refilling of the toner T, the toner particles which have scattered over the various areas of the units G and H, inclusive of the internal surface of the aforementioned magnetic toner seal 50*d*, are cleaned. Then, the components are reattached.

Figure 28:
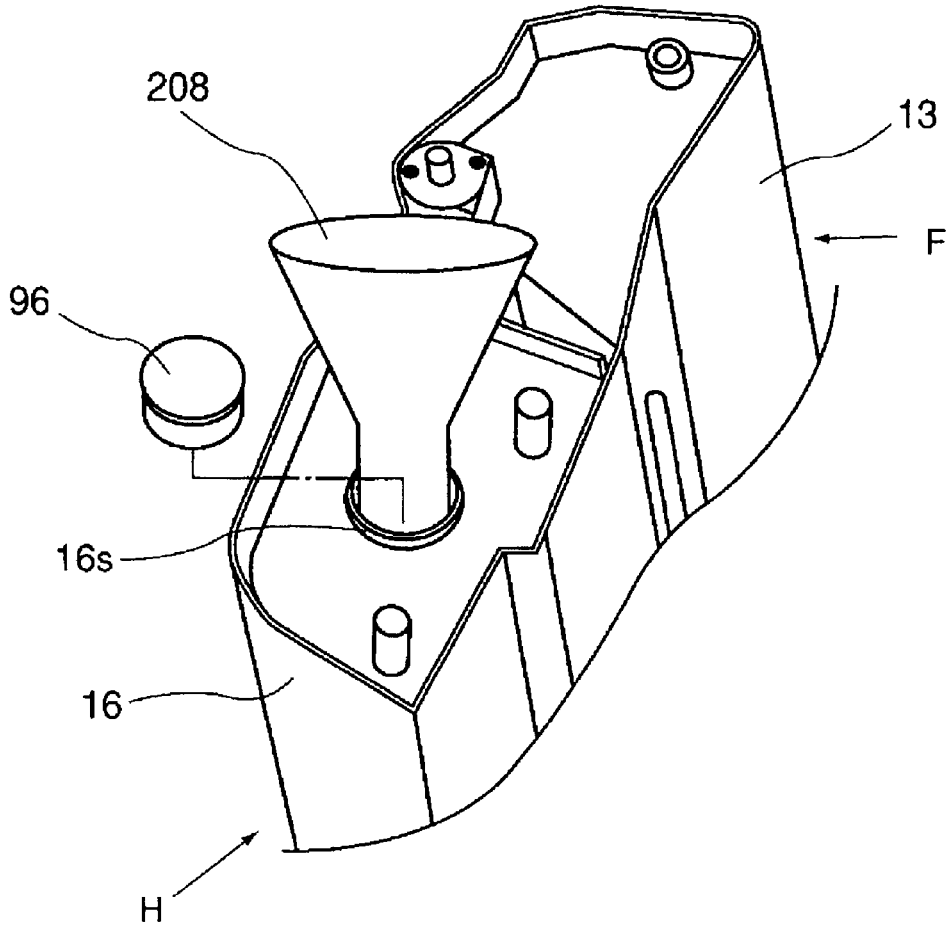
FIG. 28 is a perspective drawing for showing the method for filling toner through the toner inlet.

The second method is as follows. The toner T is refilled after the attachment of the development blade 40 and development roller 18, as shown in FIG. 25. More specifically, referring to FIG. 28, a toner cap 96 inserted in the toner inlet 16*s* of the developer holding frame 16 is removed, and the toner T is filled into the developer holding frame 16 by a necessary amount through the toner inlet 16*s*, with the use of the tool 208 such as a funnel or the like, if necessary. After the refilling of the toner T, the toner inlet 16*s* is recapped with the same toner cap 96, provided that the same toner cap 96 is reusable. When it is damaged, or has become defective for some reason, it is replaced with a new toner cap, which is inserted into the toner inlet 16*s*. If the toner T adheres to the adjacencies of the toner inlet 16*s*, or the other places, it is to be removed after the refilling of the developer holding frame 16 with the toner T. FIG. 28 shows the refilling of the toner T being carried out after the joining of the developing apparatus D and cleaning unit F. However, the refilling may be carried out before the joining of the developing apparatus D and cleaning unit F.

(Process for Attaching End Cover)

Figure 29:
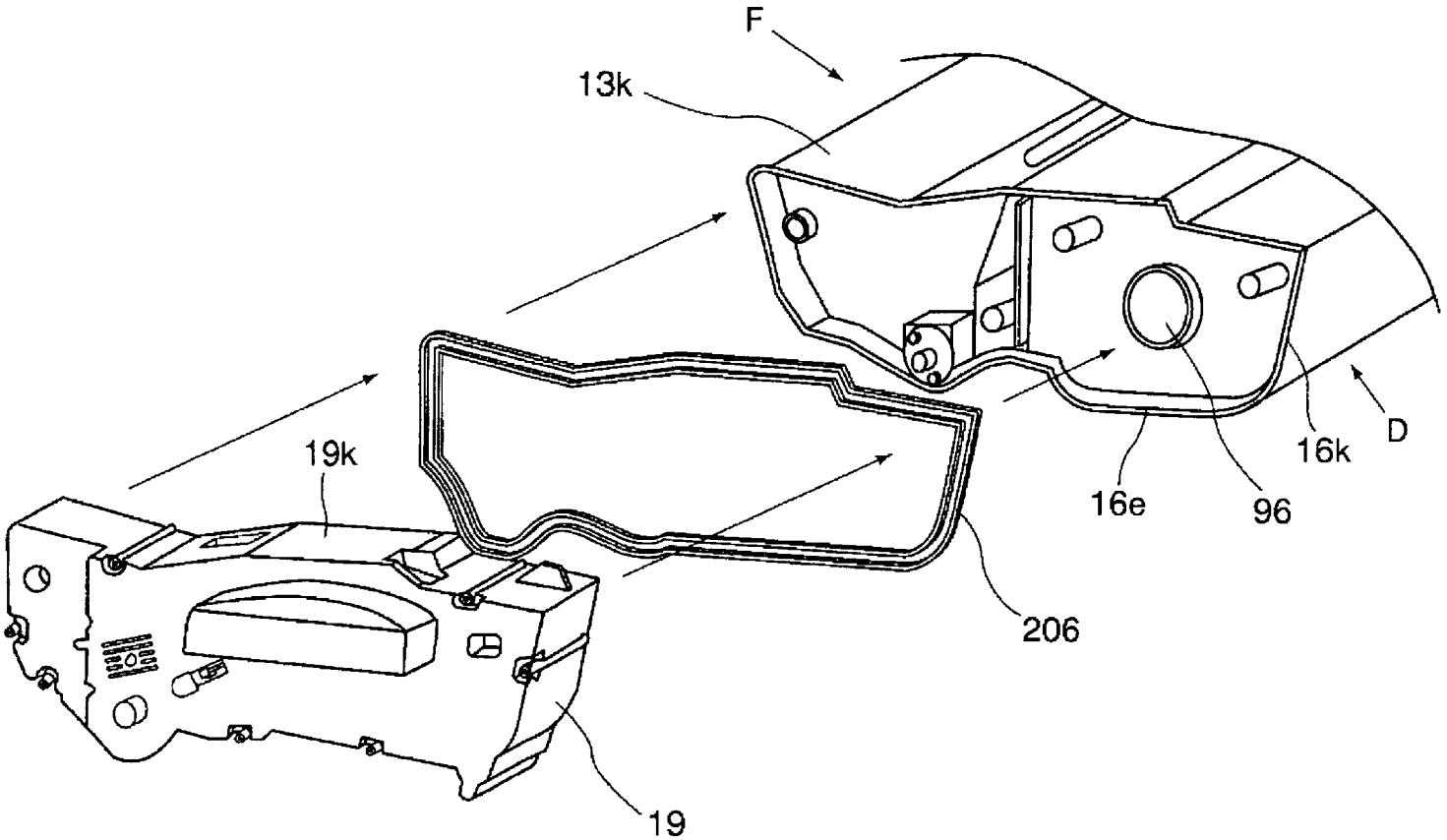
FIG. 29 is a perspective drawing for showing the method for reattaching one of the end covers.

Next, the end covers 19 and 20 are attached, following in reverse the steps followed to detach them. In other words, first, the jigs 202 fitted during the disassembly of the developing apparatus D are removed. It is desired that during this process, the jointing sheet 21 is re-examined for tear. If a tear is found, it may be repaired with a piece of tape or the like, provided that the tear is small. Next, referring to FIG. 29, the end cover 19 is attached to the cleaning unit F and developing apparatus D. During this process, in order to adjust the position of the end cover 19 relative to the combination of the cleaning unit F and developing apparatus D in terms of the lengthwise direction of the cartridge 15, in other words, in order to adjust the dimension of the cartridge 15 in terms of its lengthwise direction, a spacer 206, the thickness of which is equal to the thickness of the portion of the joint 19*i* removed by the milling cutter of the aforementioned milling machine, is placed between the end cover 19, and the combination of the cleaning unit F and developing apparatus D. The spacer 206 may be pasted to the position other than the above described one. The end cover 20 is attached to the cleaning unit F and developing apparatus D using the same method as the one used for the end cover 19.

There are various methods for solidly attaching the end covers 19 and 20. For example, a piece of double-sided adhesive tape may be pasted on both surfaces of the spacer 206, or the end covers 19 and 20, and the combination of the cleaning unit F and developing apparatus D, may be clamped together by their projections and recesses, with the use of clips or the like. Further, small screws may be screwed into the shaft of an idler gear (unshown) supported by the end covers 19 and 20.

With the employment of an overhauling method such as the one described above, a process cartridge with an expired service life can be used again.

[Embodiment 2 of Process Cartridge Reassembling Method]

Figure 30:
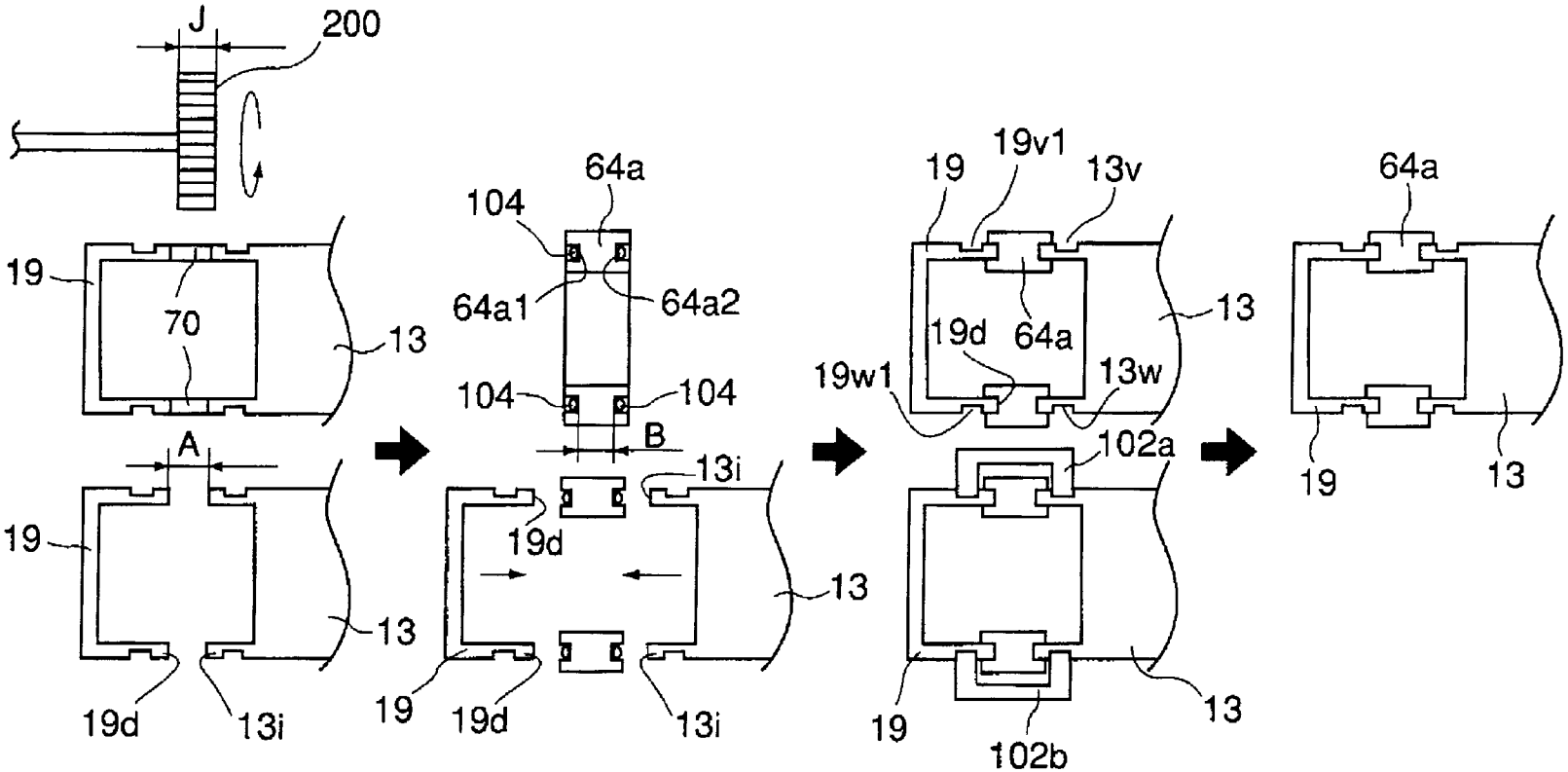
FIG. 30 is an assembly diagram for showing the method for reattaching one of the end covers, in the second embodiment of the present invention.

Next, referring to FIGS. 30–33, another method for reassembling the cartridge 15, which has been disassembled as described above, will be described in detail regarding the end covers 19 and 20. The cutting of the end cover 19 is the same as that in Embodiment 1, and the processes thereafter are as follows. FIG. 30, which is a schematic drawing, shows only the cleaning unit F side; the development unit D side is the same as the cleaning unit F side.

The first step is for preparing the second end cover 19, cleaning unit F, and developing apparatus D, which have been separated.

The second step is for preparing a plurality of H-shaped spacers 64*a*, which are positioning members, in place of the spacer 206. The width of the actual spacing portion of each spacer 64*a* is identical to the width A of the portion 70 of the cartridge 15, which has been eliminated during the disassembly of the cartridge 15, or is a width B, which is virtually the same as the width A. The value of the width A of the portion eliminated during the disassembly of the cartridge 15 is determined by the value of the blade width J of the milling cutter used for the milling. Then, adhesive 104, hot melt, adhesive tape, or the like, is coated or pasted on the surfaces 64*a*1 and 64*a*2 of the spacer 64*a*, the distance between which determines the value of the width B of the actual spacing portion of the spacer 64*a*. Instead, the spacers 64*a* may be provided in advance with the adhesive, hot melt, double-side tape, or the like.

Figure 31:
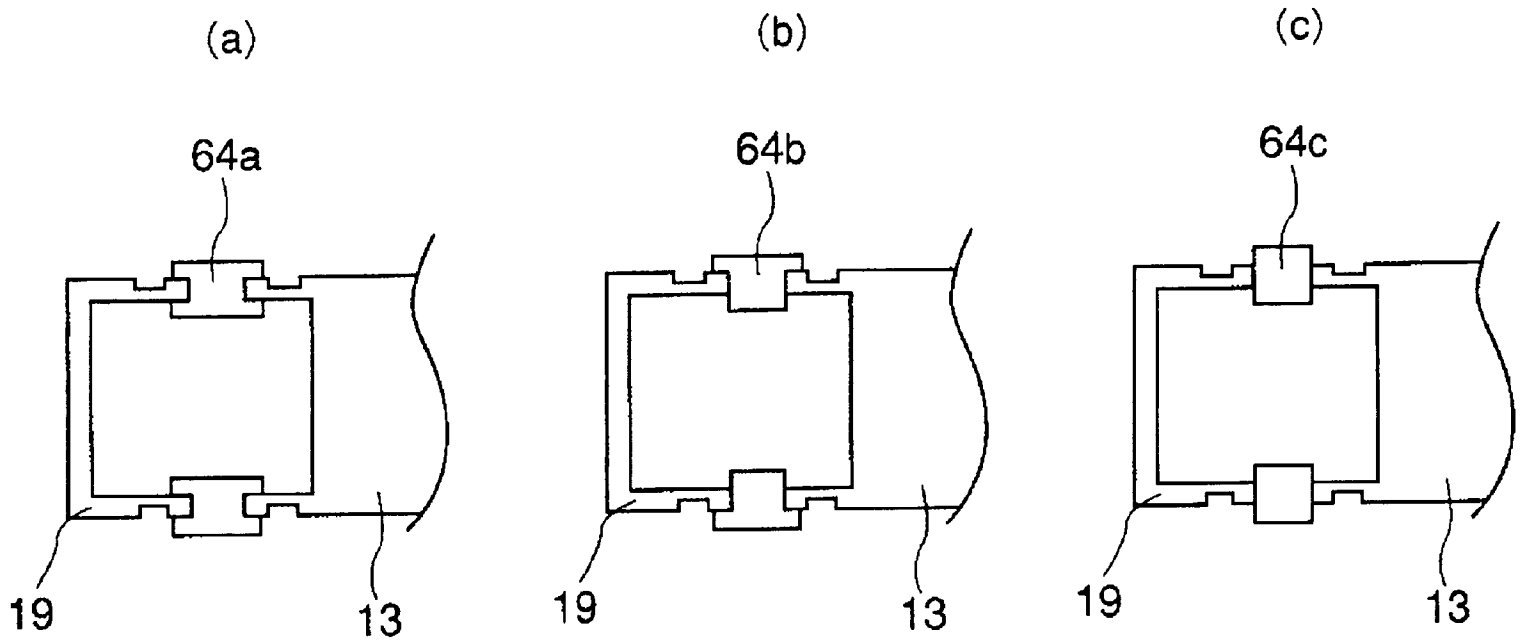
FIGS. 31(*a*), 31(*b*), and 31(*c*) are sectional views of different spacers, one for one.

In the third step, the H-shaped spacers 64*a* are sandwiched between the second end cover 19, and the combination of the drum holding frame 13, and developer holding frame 16 (unshown), from which the second end cover 19 has been separated. As a result, the inward edge 19*d* of the end cover 19, which has been created by the milling of the end cover 19 by the milling cutter 200, comes into contact with the surface 64*a*1 of the H-shaped spacer 64*a*. At the same time, the outward edge 13*i*, which has been created by the milling of the drum holding frame 13 by the milling cutter 200, and the outward edge 16*e* (FIG. 29), which has been created by the milling of the developer holding frame 16 by the milling cutter 200, come into contact with the surface 64*a*2 of the H-shaped spacer 64*a*. Referring to FIG. 31, as for the shape of the cross section of the space 206, an H-shape (64*a*) in FIG. 31(*a*), a T-shape (64*b*) in FIG. 31(*b*), and an I-shape (64*c*) in FIG. 31(*c*), are conceivable. The configuration of the spacer 206 may be such that the spacer 206 makes full contact with the entireties of the inward edges 19*k* and 20*m* of the end covers 19 and 20, respectively, created by the milling, and the entireties of the outward edges 13*k* and 16*k* (FIG. 29) of the drum holding frame 13 and developer holding frame 16, respectively, created by the milling, or makes partial contact with them.

Figure 32:
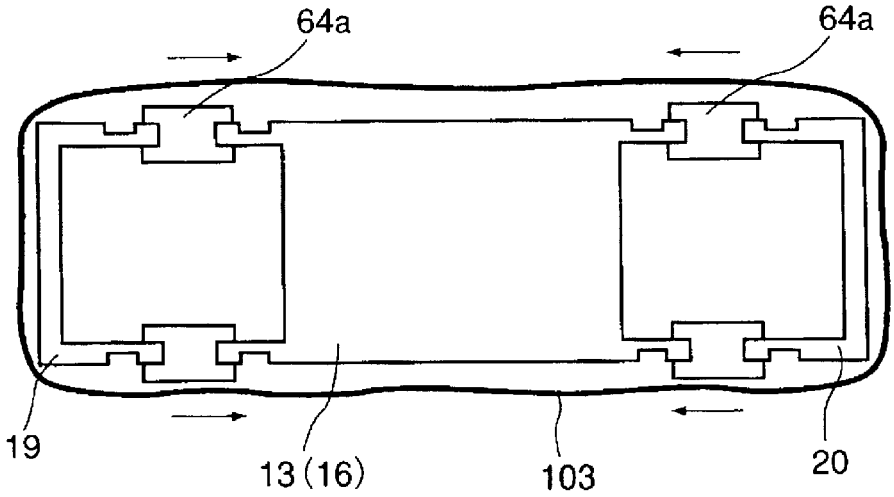
FIG. 32 is a sectional view of the spacers and their adjacencies, for showing how the spacers are held.
Figure 33:
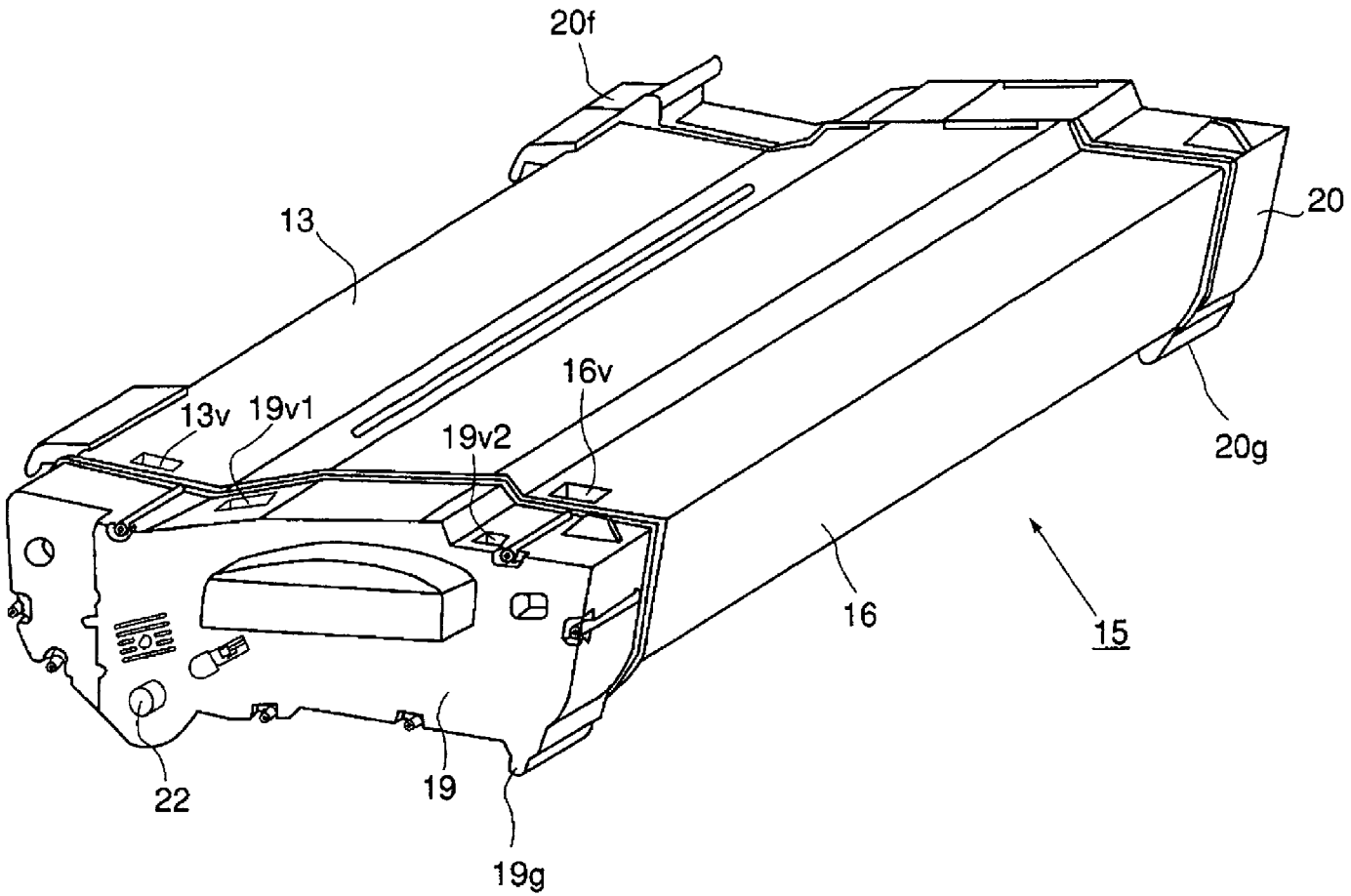
FIG. 33 is a perspective view of the process cartridge.

In the fourth step, referring to FIGS. 30 and 33, jigs 102*a* and 102*b* are attached to the end cover 19, drum holding frame 13, and developer holding frame 16. More specifically, one end of one of the jigs 102*a* is inserted in the recess 19*v*1 of the end cover 19, and the other end of the same jig 102*a* is inserted in the recess 13*v* of the cleaning means holding frame 13, whereas one end of the other jig 102*a* is inserted in the recess 19*v*2 of the end cover 19, and the other end of the same jig 102*a* is inserted in the recess 16*v* of the toner storage container 16. Further, one end of one of the jigs 102*b* is inserted in the recess 19*w*1 of the end cover 19, and the other end of the same jig 102*b* is inserted in the recess 13*w* of the cleaning means holding frame 13, whereas one end of the other jig 102*b* is inserted in the recess 19*w*2 of the end cover 19, and the other end of the same jig 102*b* is inserted in the recess 16*w* of the toner storage container 16. (FIG. 33 shows only the top side of the process cartridge, and therefore, the recesses 16*w* and 19*w*2 on the bottom side are not shown in FIG. 33). After the insertion, the jigs 102*a* and 102*b* are held therein until the adhesive 104 between the joining surfaces dries or solidifies. Each of the jigs 102*a* and 102*b* is a single piece component, which can be placed across the milled portions of the end cover 19 and drum holding frame 13, or across the milled portions of the end cover 19 and developer holding frame 16. Referring to FIG. 32, instead of the jigs 102*a* and 102*b*, an elastic member 103 may be used to keep the end covers 19 and 20 pressed against the drum holding frame 13 and developer holding frame 16 placed between the two end covers 19 and 20, until the adhesive 104 between the joining surfaces dries or solidifies.

FIG. 30 shows the joint portion of the end cover 19 and drum holding frame 13. As far as the structural arrangement is concerned, the joint portions between the end cover 19 and developer holding frame 16, between the end cover 20 and drum holding frame 13, and between the end cover 20 and developer holding frame 16, are the same. Therefore, their descriptions are the same as the above given description of the structure of the joint portion between the end cover 19 and drum holding frame 13, being therefore omitted here.

According to this embodiment, in the first step, or the step for attaching the first and second end covers to the lengthwise ends of the combination of the drum holding frame 13 and developer holding frame 13, one for one, the spacers 206 for adjusting the positions of the first and second end covers relative to the combination of the frames 13 and 16 in terms of the lengthwise direction of the process cartridge are placed between the first end cover and the combination of the drum holding frame 13 and developer holding frame 16, and between the second end cover and the combination of the drum holding frame 13 and developer holding frame 16, and solidly fixed thereto. Therefore, the cartridge 15 is reassembled as accurately as the original cartridge 15. Further, a larger number of components can be recycled.

Each of the overhauling processes in the above described embodiments is carried out without attaching a toner seal, which is for blocking the developer delivery hole of the developer holding frame provided for delivering the developer stored in the developer storage portion of the developer storage portion to the development roller, to the surrounding edge of the developer delivery hole.

Those processes in the process cartridge remanufacturing method in accordance with the present invention may be changed in order as necessary.

The above described embodiments of the present invention include a process cartridge remanufacturing method which involves simultaneously a substantial number of process cartridges with an expired service life, as well as a process cartridge remanufacturing method which involves a single process cartridge with an expired service life. In the case of the former, a substantial number of expired process cartridges are recovered, and disassembled. Then, the components removed from the disassembled process cartridges are sorted into groups of the identical components. Then, as large as possible a number of process cartridges are reassembled from the groups of sorted recyclable components, and some new replacement components for the nonrecyclable old components. In the case of the latter, the expired process cartridges are remanufactured one by one. In other words, each time an expired process cartridge is recovered, it is disassembled, and reassembled using the same old components removed therefrom, some new replacement components for the nonrecyclable old components, or some old recyclable components removed from the other recovered cartridges.

The present invention includes any of the following cases:

(1) each expired process cartridge is overhauled using only the components therein;

(2) each expired process cartridge is overhauled using, in principle, the components therein, with the exception of the new replacement components, or the recyclable old components from the other expired cartridge, which replace the original components nonrecyclable due to service life expiration, damages, malfunctions, or the like;

(3) a plurality of expired process cartridges are overhauled together; the components removed from the plurality of expired process cartridges are sorted into groups of the identical components, and as large as possible a number of process cartridges are reassembled using only the components from the groups of the original components; and (4) a plurality of expired process cartridges are overhauled together; the components removed from the plurality of expired process cartridges are sorted into groups of the identical components, and as large as possible a number of process cartridges are reassembled using, in principle, the components from the groups of the original components, except for a certain number of new replacement components which replace the original components nonrecyclable due to service life expiration, damages, malfunctions, or the like.

The aforementioned components means the structural components disclosed in the claim portion of this specification, that is, the components which make up the above described portions of the process cartridge. It also includes the smallest components or units, into which the process cartridge can be disassembled.

As described above, the present invention is a realization of a simple method for remanufacturing a process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a process cartridge detachably mountable to a main assembly of an electrophotographic image forming apparatus, wherein the process cartridge includes a drum holding frame supporting an electrophotographic photosensitive drum and having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus, a developing means frame supporting a developing roller for developing an electrostatic latent image formed on the electrophotographic photosensitive drum, a developer accommodating frame having a developer accommodating portion for accommodating a developer to be used to develop the electrostatic latent image by the developing roller, a first end cover fixed to one longitudinal end of the drum holding frame and to one longitudinal end of the developer accommodating frame at one longitudinal end of the developing means frame, and a second end cover fixed to the other longitudinal end of the drum holding frame and to one longitudinal end of the developer accommodating frame at the other longitudinal end of the developing means frame, the second end cover including a grip for facilitating mounting and demounting of the process cartridge relative to the main assembly of the electrophotographic image forming apparatus, said method comprising:

(a) a first end cover removing step of cutting a fixing portion between the first end cover and the drum holding frame and cutting a fixing portion between the first end cover and the developer accommodating frame, and removing the first end cover at the other longitudinal ends of the drum holding frame, the developing means frame and the developer accommodating frame;

(b) a second end cover removing step of cutting a fixing portion between the second end cover and the drum holding frame and cutting a fixing portion between the second end cover and the developer accommodating frame, and removing the second end cover at the other longitudinal ends of the drum holding frame, the developing means frame and the developer accommodating frame;

(c) a drum holding frame separating step of pulling, after the first and second end covers are removed, a pin provided in the one longitudinal end of the drum holding frame out of the drum holding frame, and removing a spring mounted between the one longitudinal end of the drum holding frame and the one longitudinal end of the developing means frame, and then separating the drum holding frame and the developing means frame;

(d) a drum bearing removing step of removing, at the one end, a drum bearing supporting the electrophotographic photosensitive drum at the one end;

(e) a drum shaft removing step of removing, at the other end, a drum shaft supporting the electrophotographic photosensitive drum at the other end;

(f) a drum removing step of removing the one end of the electrophotographic photosensitive drum from the drum holding frame, thus removing the photosensitive drum from the drum holding frame;

(g) a drum mounting step of inserting one end of a new electrophotographic photosensitive drum having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus, such that the driving force receiving portion is exposed outside the drum holding frame, and inserting the drum shaft at the other end from outside of the drum holding frame, thus mounting a new electrophotographic photosensitive drum to the drum holding frame;

(h) a developing frame coupling step of inserting, after the new electrophotographic photosensitive drum is mounted to the drum holding frame, the pin through or into the one longitudinal end of the drum holding frame and the one longitudinal end of the developing means frame, and mounting the spring between the one longitudinal end of the drum holding frame and the one longitudinal end of the developing means frame, thus coupling the drum holding frame and the developing means frame;

(i) a developer refilling step of refilling a developer into the developer accommodating portion;

(j) a first end cover mounting step of fixedly mounting a first end cover to the one longitudinal end of the drum holding frame and to the one longitudinal end of the developer accommodating frame at the one longitudinal end of the developing means frame; and (k) a second end cover mounting step of fixedly mounting a second end cover to the other longitudinal end of the drum holding frame and to the other longitudinal end of the developer accommodating frame at the one longitudinal end of the developing means frame.

2. A process cartridge remanufacturing method according to claim 1, wherein the process cartridge further includes a shutter, mounted to the first end cover and the second end cover, for protecting the electrophotographic photosensitive drum, said method further comprising:

a shutter removing step of dismounting the shutter from the first end cover and the second end cover, prior to said first end cover removing step and said second end cover removing step; and a shutter mounting step of mounting the shutter after the process cartridge is remanufactured.

3. A process cartridge remanufacturing method according to claim 1 or 2, wherein in the first end cover removing step and the second end cover removing step, cutting of the fixing portion between the first end cover and the drum holding frame, cutting of a fixing portion between the first end cover and the developer accommodating frame, cutting of the fixing portion between the second end cover and the drum holding frame, and cutting of a fixing portion between the second end cover and the developer accommodating frame, are effected by a rotating cutter, an ultrasonic cutter or a heated cutter.

4. A process cartridge remanufacturing method according to 1 or 2, further comprising, between said drum removing step and said drum mounting step:

a charging roller removing step of removing a charging roller for charging the electrophotographic photosensitive drum after the electrophotographic photosensitive drum is removed; and a cleaning blade removing step of removing a cleaning blade for removing the developer remaining on the electrophotographic photosensitive drum from the drum holding frame by unthreading a screw, after said charging roller removing step.

5. A process cartridge remanufacturing method according to claim 3, further comprising, after said cleaning blade removing step, a developer removing step of removing the developer which has been removed from the electrophotographic photosensitive drum and which is accommodated in a removed developer accommodating portion.

6. A process cartridge remanufacturing method according to claim 5, wherein in said developer removing step, the developer is removed from the removed developer accommodating portion by suction of the developer or blowing of the developer.

7. A process cartridge remanufacturing method according to claim 1 or 2, wherein in said first end cover mounting step, when the first end cover is mounted to the one longitudinal end of the drum holding frame and to the one longitudinal end of the developer accommodating frame, and in said second cover mounting step, when the second end cover is mounted to the other longitudinal end of the drum holding frame and to the other longitudinal end of the developer accommodating frame, a member for correcting longitudinal position is fixed.

8. A process cartridge remanufacturing method according to claim 1 or 2, wherein said remanufacturing of the process cartridge is carried out without mounting a seal to seal a developer supply opening, which is provided in the developer accommodating frame for permitting supply of the developer accommodated in the developer accommodating portion to the developing roller.

9. A process cartridge remanufacturing method according to claim 1 or 2, wherein in said developer refilling step, the developer is refilled into the developer accommodating portion through a developer supply opening provided in the developer accommodating frame to supply the developer accommodated in the developer accommodating portion to the developing roller, or the developer is refilled into the developer accommodating portion through a developer filling opening exposed by removing the second end cover.

10. A process cartridge remanufacturing method according to claim 1 or 2, further comprising a developing roller removing step of removing a developer roller from the developing means frame, and a developing roller mounting step of mounting the developing roller to the developing means frame.

11. A process cartridge remanufacturing method according to claim 10, wherein in said developing roller mounting step, the developing roller mounted to the developing means frame, is a new developing roller or a used developing roller.

12. A process cartridge remanufacturing method according to claim 4, further comprising:

a charging roller mounting step of mounting the charging roller to the developing means frame, after said charging roller removing step; and a cleaning blade mounting step of mounting the cleaning blade to the drum holding frame after said cleaning blade removing step.

13. A process cartridge remanufacturing method according to claim 12, wherein in said charging roller mounting step, the charging roller mounted to the drum holding frame, is a new charging roller or a used charging roller, and wherein in said cleaning blade mounting step, the cleaning blade mounted to the drum holding frame, is a new cleaning blade or a used cleaning blade.

14. A process cartridge remanufacturing method according to claim 10, wherein the developing means frame and the developer accommodating frame are united by a flexible seal along their longitudinal directions, and the developing means frame and the developer accomodating frame are fixed to each other during at least one of said drum removing step, said developing frame coupling step, said developer refilling step, said developing roller removing step arid said developing roller mounting step.

15. A remanufacturing method for a process cartridge detachably mountable to a main assembly of an electrophotographic image forming apparatus, wherein the process cartridge includes a drum holding frame supporting an electrophotographic photosensitive drum having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus, a developing means frame supporting a developing roller for developing an electrostatic latent image formed on the electrophotographic photosensitive drum, a developer accommodating frame having a developer accommodating portion for accommodating a developer to be used to develop the electrostatic latent image by the developing roller, a first end cover fixed to one longitudinal end of the drum holding frame and to one longitudinal end of the developer accommodating frame at one longitudinal end of the developing means frame, and a second end cover fixed to the other longitudinal end of the drum holding frame and to one longitudinal end of the developer accommodating frame at the other longitudinal end of the developing means frame, the second end cover including a grip for facilitating mounting and demounting of the process cartridge relative to the main assembly of the electrophotographic image forming apparatus, said method comprising:

(a) a first end cover removing step of cutting a fixing portion between the first end cover and the drum holding frame and cutting a fixing portion between the first end cover and the developer accommodating frame, and removing the first end cover at the other longitudinal ends of the drum holding frame, the developing means frame, and the developer accommodating frame;

(b) a second end cover removing step of cutting a fixing portion between the second end cover and the drum holding frame and cutting a fixing portion between the second end cover and the developer accommodating frame, and removing the second end cover at the other longitudinal ends of the drum holding frame, the developing means frame and the developer accommodating frame;

(c) a drum holding frame separating step of pulling, after the end covers are removed, a pin provided in the one longitudinal end of the drum holding frame out of the drum holding frame, and removing a spring mounted between the one longitudinal end of the drum holding frame and the one longitudinal end of the developing means frame, and then separating the drum holding frame and the developing means frame;

(d) a drum bearing removing step of removing, at the one end, a drum bearing supporting the electrophotographic photosensitive drum at the one end;

(e) a drum shaft removing step of removing, at the other end, a drum shaft supporting the electrophotographic photosensitive drum at the other end;

(f) a drum removing step of removing the one end of the electrophotographic photosensitive drum from the drum holding frame, thus removing the photosensitive drum from the drum holding frame;

(g) a drum mounting step of inserting one end of a new electrophotographic photosensitive drum having at one end a driving force receiving portion for receiving a driving force for rotating the electrophotographic photosensitive drum from the main assembly of the electrophotographic image forming apparatus when the process cartridge is mounted to the main assembly of the electrophotographic image forming apparatus, such that the driving force receiving portion is exposed outside the drum holding frame, and inserting the drum shaft at the other end from outside of the drum holding frame, thus mounting a new electrophotographic photosensitive drum to the drum holding frame;

(h) a developing frame coupling step of inserting, after the electrophotographic photosensitive drum is mounted to the drum holding frame, the pin through or into the one longitudinal end of drum holding frame and the one longitudinal end of the developing means frame, and mounting the spring between the one longitudinal end of the drum holding frame and the one longitudinal end of the developing means frame, thus coupling the drum holding frame and the developing means frame;

(i) a developer refilling step of refilling a developer into the developer accommodating portion;

(j) a first end cover mounting step of fixedly mounting a first end cover to the one longitudinal end of the drum holding frame and to the one longitudinal end of the developer accommodating frame at the one longitudinal end of the developing means frame; and (k) a second end cover mounting step of fixedly mounting a second end cover to the other longitudinal end of the drum holding frame and to the other longitudinal end of the developer accommodating frame at the one longitudinal end of the developing means frame, wherein in said first end cover mounting step, when the first end cover is mounted to the one longitudinal end of the drum holding frame and to the one longitudinal end of the developer accommodating frame, and in said second cover mounting step, when the second end cover is mounted to the other longitudinal end of the drum holding frame and to the other longitudinal end of the developer accommodating frame, a member for correcting longitudinal position is fixed.

16. A process cartridge remanufacturing method according to claim 15, wherein the process cartridge further including a shutter, mounted to the first end cover and the second end cover, for protecting the electrophotographic photosensitive drum, said method further comprising:

a shutter removing step of dismounting the shutter from the first end cover and the second end cover, prior to said first end cover removing step and said second end cover removing step; and a shutter mounting step of mounting the shutter after the process cartridge is remanufactured.

17. A process cartridge remanufacturing method according to claim 15, wherein in said first end cover removing step and said second end cover removing step, cutting of the fixing portion between the first end cover and the drum holding frame, cutting of a fixing portion between the first end cover and the developer accommodating frame, cutting of the fixing portion between the second end cover and the drum holding frame, and cutting of a fixing portion between the second end cover and the developer accommodating frame, are effected by a rotating cutter, an ultrasonic cutter or a heated cutter.

18. A process cartridge remanufacturing method according to claim 15 or 16, further comprising, between said drum removing step and said drum mounting step:

a charging roller removing step of removing a charging roller for charging the electrophotographic photosensitive drum after the electrophotographic photosensitive drum is removed; and a cleaning blade removing step of removing a cleaning blade for removing the developer remaining on the electrophotographic photosensitive drum from the drum holding frame by unthreading a screw, after said charging roller removing step.

19. A process cartridge remanufacturing method according to claim 18, wherein in said charging roller removing step, a force is applied to the developer accommodating frame in a direction away from the drum holding frame when the force is applied to the developing means frame, so that developing frame is separated.

20. A process cartridge remanufacturing method according to claim 19, further comprising, between said drum removing step and said drum mounting step:

a charging roller removing step of removing a charging roller for charging the electrophotographic photosensitive drum after the electrophotographic photosensitive drum is removed;

a cleaning blade removing step of removing a cleaning blade for removing the developer remaining on the electrophotographic photosensitive drum from the drum holding frame by unthreading a screw, after said charging roller removing step;

a cleaning blade mounting step of mounting the cleaning blade to the drum holding frame by the screw; and a charging roller mounting step of mounting the charging roller to the drum holding frame.

21. A process cartridge remanufacturing method according to claim 15 or 17, wherein the remanufacturing of the process cartridge is carried out without mounting a seal to seal a developer supply opening, which is provided in the developer accommodating frame for permitting supply of the developer accommodated in the developer accommodating portion to the developing roller.

22. A process cartridge remanufacturing method according to claim 15 or 17, wherein in said developer refilling step, the developer is refilled into the developer accommodating portion through a developer supply opening provided in the developer accommodating frame to supply the developer accommodated in the developer accommodating portion to the developing roller, or the developer is refilled into the developer accommodating portion through a developer filling opening exposed by removing the second end cover.

23. A process cartridge remanufacturing method according to claim 15 or 17, further comprising a developing roller removing step of removing a developer roller from the developing means frame, and a developing roller mounting step of mounting the developing roller to the developing means frame.

24. A process cartridge remanufacturing method according to claim 23, wherein in said developing roller mounting step, the developing roller mounted to the developing means frame is a new developing roller or a used developing roller.

25. A process cartridge remanufacturing method according to claim 18, further comprising:

a charging roller mounting step of mounting the charging roller to the developing means frame, after said charging roller removing step; and a cleaning blade mounting step of mounting the cleaning blade to the drum holding frame after said cleaning blade removing step.

26. A process cartridge remanufacturing method according to claim 25, wherein in said charging roller mounting step, the charging roller mounted to the drum holding frame is a new charging roller or a used charging roller, and wherein in said cleaning blade mounting step, the cleaning blade mounted to the drum holding frame is a new cleaning blade or a used cleaning blade.

27. A process cartridge remanufacturing method according to claim 23, wherein the developing means frame and the developer accommodating frame are united by a flexible seal along their longitudinal directions, and the developing means frame and the developer accommodating frame are fixed to each other during at least one of said drum removing step, said developing frame coupling step, said developer refilling step, said developing roller removing step and said developing roller mounting step.

* * * * *

UNITED STATES PATENT AND TRADEMARK OFFICE

CERTIFICATE OF CORRECTION

PATENT NO. : 6,795,666 B2
DATED : September 21, 2004
INVENTOR(S) : Shigeo Miyabe et al.

It is certified that error appears in the above-identified patent and that said Letters Patent is hereby corrected as shown below:

Column 9,
Line 4, “Joining” should read -- joining --.
Lines 19, 45 and 63, “above described” should read -- above-described --.

Column 11,
Lines 7 and 51, “above described” should read -- above-described --.

Column 13,
Line 58, “the” (first occurrence) should be deleted.

Column 16,
Line 23, “above mentioned” should read -- above-mentioned --.

Column 17,
Line 5, “above described” should read -- above-described --.

Column 19,
Line 3, “above described” should read -- above-described --.

Column 20,
Line 58, “above described” should read -- above-described --.

Column 21,
Lines 1 and 52, “above described” should read -- above-described --.

UNITED STATES PATENT AND TRADEMARK OFFICE

CERTIFICATE OF CORRECTION

PATENT NO. : 6,795,666 B2
DATED : September 21, 2004
INVENTOR(S) : Shigeo Miyabe et al.

It is certified that error appears in the above-identified patent and that said Letters Patent is hereby corrected as shown below:

Column 24,
Line 66, "arid" should read -- and --.

Signed and Sealed this

Twenty-second Day of February, 2005

JON W. DUDAS
*Director of the United States Patent and Trademark Office*